US007178187B2

(12) United States Patent
Barman et al.

(10) Patent No.: US 7,178,187 B2
(45) Date of Patent: Feb. 20, 2007

(54) ASYMMETRIC SPRING COMPONENTS AND INNERSPRINGS FOR ONE-SIDED MATTRESSES

(75) Inventors: Bruce G. Barman, Greensboro, NC (US); Larry DeMoss, Jamestown, NC (US)

(73) Assignee: Sealy Technology LLC, Trinity, NC (US)

( * ) Notice: Subject to any disclaimer, the term of this patent is extended or adjusted under 35 U.S.C. 154(b) by 0 days.

(21) Appl. No.: 10/929,137

(22) Filed: Aug. 28, 2004

(65) Prior Publication Data

US 2006/0042016 A1 Mar. 2, 2006

(51) Int. Cl.

| | |
|---|---|
| ***A47C 23/04*** | (2006.01) |
| ***A47C 27/07*** | (2006.01) |
| ***F16F 1/06*** | (2006.01) |
| ***F16F 3/04*** | (2006.01) |

(52) U.S. Cl. ..... 5/716; 5/720; 5/256; 267/91; 267/166.1; 267/180

(58) Field of Classification Search ..... 5/716, 5/720, 248, 251, 256, 269, 655.7, 655.8; 267/91, 103, 166, 167, 166.1, 180
See application file for complete search history.

(56) References Cited

U.S. PATENT DOCUMENTS

| | | | | | |
|---|---|---|---|---|---|
| 26,954 | A | * | 1/1860 | Peck, Jr. | 5/256 |
| 85,938 | A | * | 1/1869 | Kirkpatrick | 5/254 |
| 140,975 | A | * | 7/1873 | Van Wert et al. | 5/258 |
| 274,715 | A | * | 3/1883 | Buckley | 267/180 |
| 380,651 | A | * | 4/1888 | Fowler et al. | 267/166.1 |
| 485,652 | A | * | 11/1892 | Pfingst | 267/166 |
| 569,256 | A | * | 10/1896 | Van Cise | 5/264.1 |
| 1,250,892 | A | * | 12/1917 | Johnson | 5/720 |
| 1,744,389 | A | * | 1/1930 | Karr | 5/269 |
| 1,751,261 | A | * | 3/1930 | Wilson | 267/166.1 |
| 1,798,885 | A | * | 3/1931 | Karr | 5/269 |
| 1,804,821 | A | * | 5/1931 | Stackhouse | 267/101 |
| 1,839,325 | A | * | 1/1932 | Marquardt | 5/269 |
| 1,879,172 | A | * | 9/1932 | Gail | 5/269 |
| 1,907,324 | A | * | 5/1933 | Kirchner | 5/269 |
| 2,480,158 | A | * | 8/1949 | Owen | 267/91 |
| 3,751,025 | A | * | 8/1973 | Beery et al. | 267/166.1 |
| 4,077,619 | A | * | 3/1978 | Borlinghaus | 267/166.1 |
| 4,111,407 | A | * | 9/1978 | Stager | 267/166.1 |
| 4,535,978 | A | * | 8/1985 | Wagner | 267/91 |
| 4,548,390 | A | * | 10/1985 | Sasaki | 267/91 |
| 4,664,361 | A | * | 5/1987 | Sasaki | 267/100 |
| 4,726,572 | A | * | 2/1988 | Flesher et al. | 267/91 |
| 5,040,255 | A | | 8/1991 | Barber, Jr. | |
| 5,127,635 | A | | 7/1992 | Long et al. | |

(Continued)

*Primary Examiner*—Robert G Santos
(74) *Attorney, Agent, or Firm*—Roetzel & Andress

(57) ABSTRACT

Asymmetric spring components for mattress and other flexible support structures, in the form of helical coil springs with turns in the coil body having varying pitch angles and radii, and a single support end for use in a one sided innersprings in one-sided mattresses. The coil springs are asymmetric about an axis of the coil or a horizontal reference plane, or both, and with ends of the coil springs shaped and sized differently to accommodate different mounting and support arrangements. Asymmetric coil springs can be contained in individual pockets or strings of pockets and arranged together to form an asymmetric pocketed coil innerspring for use in a one-sided mattress.

14 Claims, 32 Drawing Sheets

U.S. PATENT DOCUMENTS 5,222,264 A 6/1993 Morry
5,319,815 A 6/1994 Stumpf et al.
5,701,623 A 12/1997 May
5,713,088 A * 2/1998 Wagner et al. ..... 5/256
5,720,471 A 2/1998 Constantinescu
5,868,383 A * 2/1999 Codos ..... 267/80
6,134,729 A 10/2000 Quintile et al.
6,243,900 B1 6/2001 Gladney et al.
6,256,820 B1 * 7/2001 Moser et al. ..... 5/655.8
6,260,223 B1 7/2001 Mossbeck et al.
6,318,416 B1 * 11/2001 Grueninger ..... 140/3 CA
6,336,305 B1 1/2002 Graf et al.
6,339,857 B1 * 1/2002 Clayton ..... 5/716
6,398,199 B1 6/2002 Barber
6,408,469 B2 6/2002 Gladney et al.
6,481,701 B2 * 11/2002 Kessen et al. ..... 267/166
6,931,685 B2 * 8/2005 Kuchel et al. ..... 5/716
2001/0008030 A1 7/2001 Gladney et al.
2001/0013147 A1 8/2001 Fogel
2002/0125623 A1 * 9/2002 Kessen et al. ..... 267/221
2004/0025257 A1 2/2004 Ahlqvist
2006/0042016 A1 * 3/2006 Barman et al. ..... 5/716

* cited by examiner

ASYMMETRIC SPRING COMPONENTS AND INNERSPRINGS FOR ONE-SIDED MATTRESSES

FIELD OF THE INVENTION

The present invention is in the general field of reflexive support structures such as mattresses and seating, and more specifically in the field of individual spring components and spring assemblies which are internal to reflexive support structures.

BACKGROUND OF THE INVENTION

Mattresses and other types of cushions have for decades been constructed to be "double-sided" or in other words symmetrical in cross-section, wherein the configuration and arrangement of materials and components is identical on each side. Double-sided symmetrical construction enables flipping of the cushion or mattress to obtain the same support characteristics on a fresh uncompressed side. It was long held that this was necessary to allow compressed layers of padding, particularly natural materials such as cotton batting or fowl feathers, to decompress while the opposite side was used as the support side. But with the advent of improved materials for the padding layers, including foam materials with excellent resilience which promptly return to an uncompressed or substantially uncompressed state, the padded support side does not require a prolonged recovery period as was provided by flipping to an opposite side, and in fact recovers quickly when decompressed and can maintain this performance for the life of the product. This has led to the recent development of "one-sided" mattresses, designed and constructed to have only one support permanent support side or surface, with an opposite side designed for permanent support by and contact with the top side of a box spring or foundation. One-sided or "no-flip" mattresses are thus designed to concentrate essentially all of the support and comfort features at or near the single support side, with the opposite or bottom side serving only as a platform for support by a foundation. The amount and quality of padding and other filling materials at or near the support side is therefore dramatically greater than at the opposite bottom side.

Mattresses, seating and other flexible support structures have conventionally been constructed with multiple interconnected spring components, such as steel wire springs of various configurations, which are covered with the described layers of padding and upholstery at the support side or sides of the innerspring. In double-sided mattresses with the described symmetrical layers of material on each opposing side, the internal spring components are symmetrical in both vertical and horizontal dimensions, so that they provide the same resistance forces at each end and collectively to each supporting side of the mattress. Symmetrical spring designs are also preferred for and ubiquitous in automated manufacturing by wire-forming machines which form a helical coil spring body and then form the ends of the spring with impact dies. The symmetry of a spring component about a horizontal plane means that an upper portion of the coil (on a top side of the plane) is similar in size, shape and relative position of corresponding parts same as a bottom portion of the coil (on a bottom side of the plane). The term "symmetric" is defined as having similarity in size, shape and relative position of corresponding parts. Webster's Revised Unabridged Dictionary, 1996.

In flexible support structures with a fixed orientation, such as a mattress foundation, "box spring", or sofa, springs may be mounted at one end to a framework such as a wooden frame, with the opposite ends defining a flexible support surface over which padding is placed. Springs used in this type of application may have a mounting end which is configured or shaped differently than an opposite support end, with the body of the coil transitioning from the mounting end to the support end. Coiled wire form type springs typically have a helical body which extends between ends of the coil. The helix which forms the coil body is at a fixed helical angle or pitch, primarily due to the wire forming machinery which uses a fixed gearing or cam to form the wire into a coiled helix. This gives the coil spring a fixed spring rate throughout its length and range of compression, so that the coil has a constant support characteristic or feel when compressed. Also, it is significant that in coil springs of this type the amount of material used to form the spring is the same throughout the length of the coil, even though the coil may only be compressed in a top quarter or third of its total length. With the majority of compression of a coil spring taking place only in the top quarter or third of the coil height, it is not necessary for the bottom three quarters or two thirds of the coil spring to be identically configured for good spring performance. The springs are symmetric only because they are installed in a symmetrical two-sided mattress where they must provide the same reflexive support to each side of the mattress when oriented up as the support side.

SUMMARY OF THE INVENTION

The present invention provides asymmetrical mattress components which are specifically designed for use in a one-sided mattress or cushion device, wherein only one side of the mattress or cushion device is designed and intended to serve as the reflexive support surface, and the opposite side designed and intended to be permanently supported by a foundation, box spring or other structure or surface. In accordance with one aspect of the invention, there are provided asymmetric mattress spring components, such as coil springs, e.g. formed wire, which have a generally helical coil body which is asymmetric relative to either a vertical plane which passes through a vertical axis of the coil body, or relative to a horizontal plane perpendicular to the axis of the coil body. "Asymmetric" means a lack of symmetry between two or more like parts, i.e., not symmetrical. American Heritage Dictionary, $4^{th}$ Ed. 2000. The asymmetric coil springs of the invention each have a base end configured for placement proximate to a support side of a one-sided mattress, and a top or support end generally opposite the base end, configured for placement proximate to a support side of a one-sided mattress. A plurality of asymmetric spring components of the invention are connected together to form an asymmetric innerspring assembly for use in a one-sided mattress. This is also referred to herein as an asymmetric innerspring assembly, or simply asymmetric innerspring.

In one example of the invention, an asymmetric coil type spring in a one-sided mattress innerspring assembly has a base end of a first diameter and a support end of a second diameter which is larger than the first diameter. A body of the coil between the mounting end and support end can be configured to have a greater density of material near the support end than near the base end, thus being asymmetric with respect to a plane which is perpendicular to an axis of the coil body, as further explained herein. In one specific embodiment of this type of coil spring, the number of turns in the wire of the coil are greater in an upper region (proximate to the support end) of the spring than in a lower region (proximate to the base or mounting end) of the spring. The asymmetric configuration of the coil is ideally suited for optimal performance in a one-sided support structure such as a one-sided mattress. The asymmetric spring coils of the invention are also balable in accordance with standard baling processes used in mass manufacture and handling operations. In another aspect of the invention, an asymmetric wire form coil spring adapted for use in a one-sided innerspring for a one-sided mattress has a generally helical coil body with a plurality of turns of wire, each turn having a radius measured from an axis of the coil body and a pitch angle, at least one of the pitch angles of the turns being greater than another of the pitch angles of the turns, and a lower end contiguous with a lower region of the coil body and lying in a plane which is generally perpendicular to the axis of the coil body, and an upper support end contiguous with an upper region of the coil body and lying in a plane which is generally perpendicular to the axis of the coil body, the upper end serving as the single support end of the coil.

In accordance with another aspect of the invention, an asymmetric mattress innerspring made of interconnected formed wire springs has a greater density of wire form material proximate to a support side of the innerspring than proximate to a base side of the innerspring, thus providing an innerspring which has only a single support surface by design. The greater density of wire form material at the support side of the innerspring performs the designed reflex support function of the innerspring, while the lesser density of wire form material at the base side of the innerspring provides structural support of the single support surface of the mattress.

And in another aspect of the invention, there is provided an asymmetric innerspring which has a plurality of interconnected asymmetric wire form coil springs, each of the coil springs having a generally helical coil body with a plurality of turns with at least two of the turns having a unique pitch or radius, a support end contiguous with one end of the coil body, and a base end contiguous with an opposite end of the coil body, the support ends of the coil springs being arranged in a plane to define a single support side to the asymmetric innerspring.

These and other aspects of the invention are described herein with reference to the accompanying Figures, which are representative of a few component designs which embody the principles and concepts of the invention, and which do not otherwise limit the scope of the invention as defined by the claims.

DETAILED DESCRIPTION OF PREFERRED AND ALTERNATE EMBODIMENTS

Figure 1A:
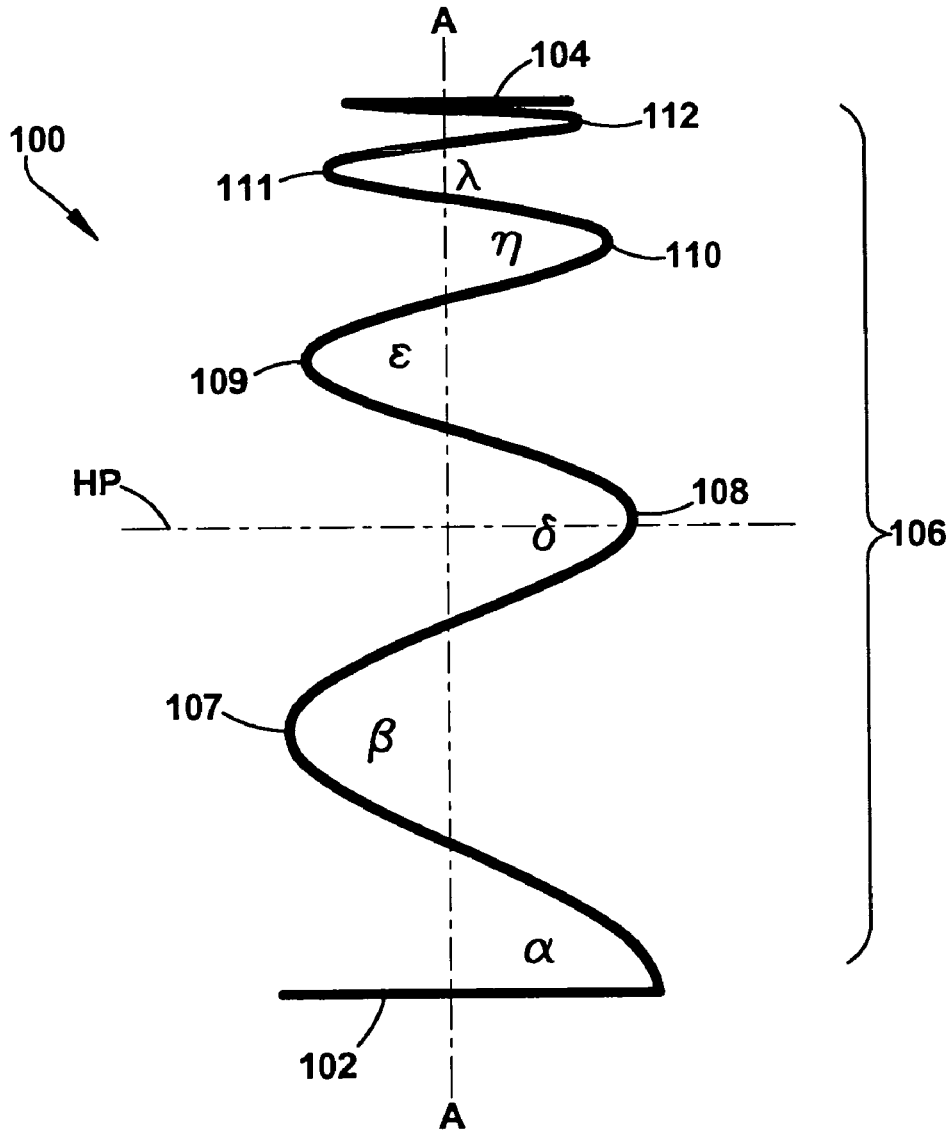
FIG. 1A is a profile view of an asymmetric spring component of the present invention.

As an example of one type of asymmetric spring component of the present invention, FIG. 1A illustrates in profile a wire form coil type spring, indicated generally at 100, which has a generally helical form coil body 106 which extends between a base or bottom end 102 and top or support end 104. The base 102 is also referred to as the bottom or the mounting end of the spring 100. The base 102 and top 104 of the coil 100 may also be referred to as the terminal convolutions. The coil body 106 is generally asymmetric about or with respect to a generally horizontal reference plane HP passing perpendicularly through the axis A of the coil as shown. The portion of the coil body 106 on the side of the reference plane HP proximate to the top or support end 104 is also referred to as the "upper region" of the coil body 106. The portion of the coil body 106 on the side of the reference plane HP proximate to the base or bottom end 102 is also referred to as the "lower region". In the asymmetric spring coils of the invention, the physical configuration of the coil body 106 on one side of plane HP is different than the physical configuration of the coil body 106 on the other side of plane HP. In the particular embodiment of FIG. 1A, there is more wire material in the coil body 106 on one side of the reference plane HP, i.e. the upper region of the coil body 106, than on the other, i.e. the lower region as a result of the differing number of turns in the coil body 106. In other embodiments, there may be more material on the side or region of the coil body proximate to the support end or top 104, while in others there may be more material on the side or region of the coil body proximate to the base or mounting end 102, either way resulting in asymmetry of the coil body and the coil as a whole. The difference in the amount of material in the coil body is generally dictated by the number and size (e.g. radius) of helical turns in the respective upper or lower region of the coil body. It is well known in the helical wire form coil spring art that the primary factors which determine the spring rate and resultant feel of a spring are wire gauge, and the number, size (diameter) and pitch (or pitch angle) of the helical turns of the coil. In general, the more turns to the coil the lower the spring rate, with a resultant softer feel and support. Larger diameter turns in a coil also contribute to a lower spring rate and consequent softer feel, although coil diameter is in most cases limited by manufacturing and innerspring assembly parameters. The pitch or pitch angle of each turn of the coil can be controlled by the rate at which the wire which forms the coil is drawn through a forming die in a coil-forming machine. A greater or steeper pitch produces a stiffer spring, due to the increased vertical orientation of the wire. A shallower pitch produces a lower spring rate and allows for a greater total number of turns in the coil body. A greater number of turns in the coil body and smaller pitch, particularly near the top support end of the coil, enhances the ability of the coil to articulate or deflect laterally in response to off-axis loads. For the asymmetric spring components of the present invention and innerspring assemblies made with asymmetric spring components, the wire gauge of the coil springs can range from 10–20 awg, with a preferred range of 11–17 awg, and a more preferred range of 12–16 awg.

Figure 1B:
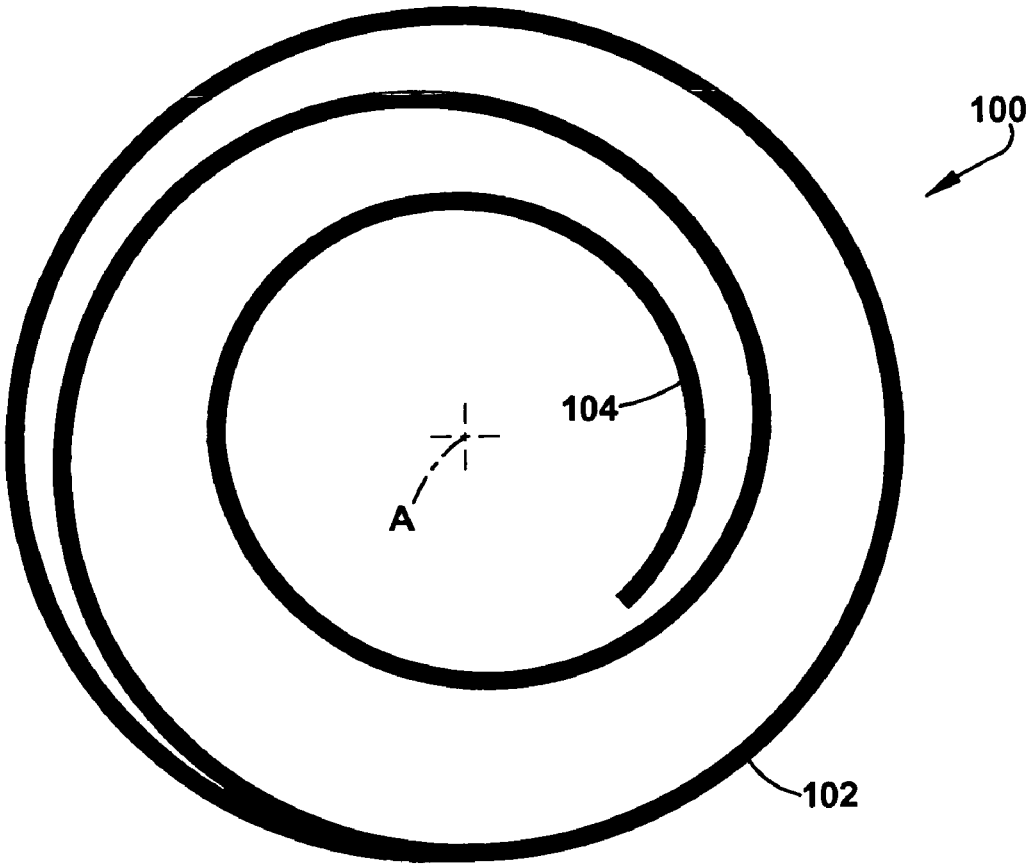
FIG. 1B is an end view of the asymmetric spring component of FIG. 1A.

The asymmetric spring coil 100 of FIGS. 1A and 1B combines the advantages of these design parameters, by combining a relatively large diameter base 102 for creating a broad base support surface, for example to the underside of an innerspring assembly, or for mounting directly to a frame or other support structure as in a box spring type foundation or in furniture or seating. The generally helical coil body 106, between ends 102 and 104, is a helix with multiple turns each with a pitch angle (also referred to herein as "pitch") which is the inclination or slope of the turn in the upward spiral pattern of the coil from the base 102. In accordance with the invention, the pitch of the turns of the coil body may be different within a single coil body, beginning with an initial pitch angle $\alpha$ to a first turn 107 extending from the base 102, which is generally the largest pitch angle among all of the pitch angles of the coil body 106, thus providing a relatively stiff lower region to the body 106 of the asymmetric coil spring 100, and using less wire material in the lower region. In this particular embodiment, the pitch angles of the turns of the coil body 106 decrease toward the top 104, with the pitch angle $\beta$ leading to turn 108 being somewhat less than pitch angle $\alpha$. This gradual decrease in the pitch angle of the coil body lessens the spring rate toward an upper region of the coil body 106, creating a softer feel or support to the spring, at least upon initial compression. This progressive decrease in the pitch angles of the coil body continues toward and to the top 104 with the pitch angles $\epsilon$, $\eta$ and $\lambda$ at turns 109, 110, 111 and 112 each being somewhat less than the preceding pitch angles. As shown in FIG. 1B, the terminal convolutions or ends 102 and 104 of the coil 100 can be formed in a circular configuration but do not necessarily have to be the same size, diameter, radius or shape. In this particular asymmetric spring coil 100, the base 102 has the largest radius measured from the coil axis A, and the top 104 has the smallest radius.

As further shown in FIG. 1B, the coil spring 100 is also configured to be asymmetrical radially, or with respect to the reference plane HP, with turn 107 having the largest radial extent relative to a central axis A of the coil body 106 but still within the radial extent of base 102, and the successive turns 108–112 having progressively smaller radii from the central axis of the coil. As smaller radiused turns of a coil spring generally increase the spring rate to a stiffer feel, this design parameter is combined with the changing pitch angles to determine the overall stiffness and feel of the coil spring 100.

Figure 2A:
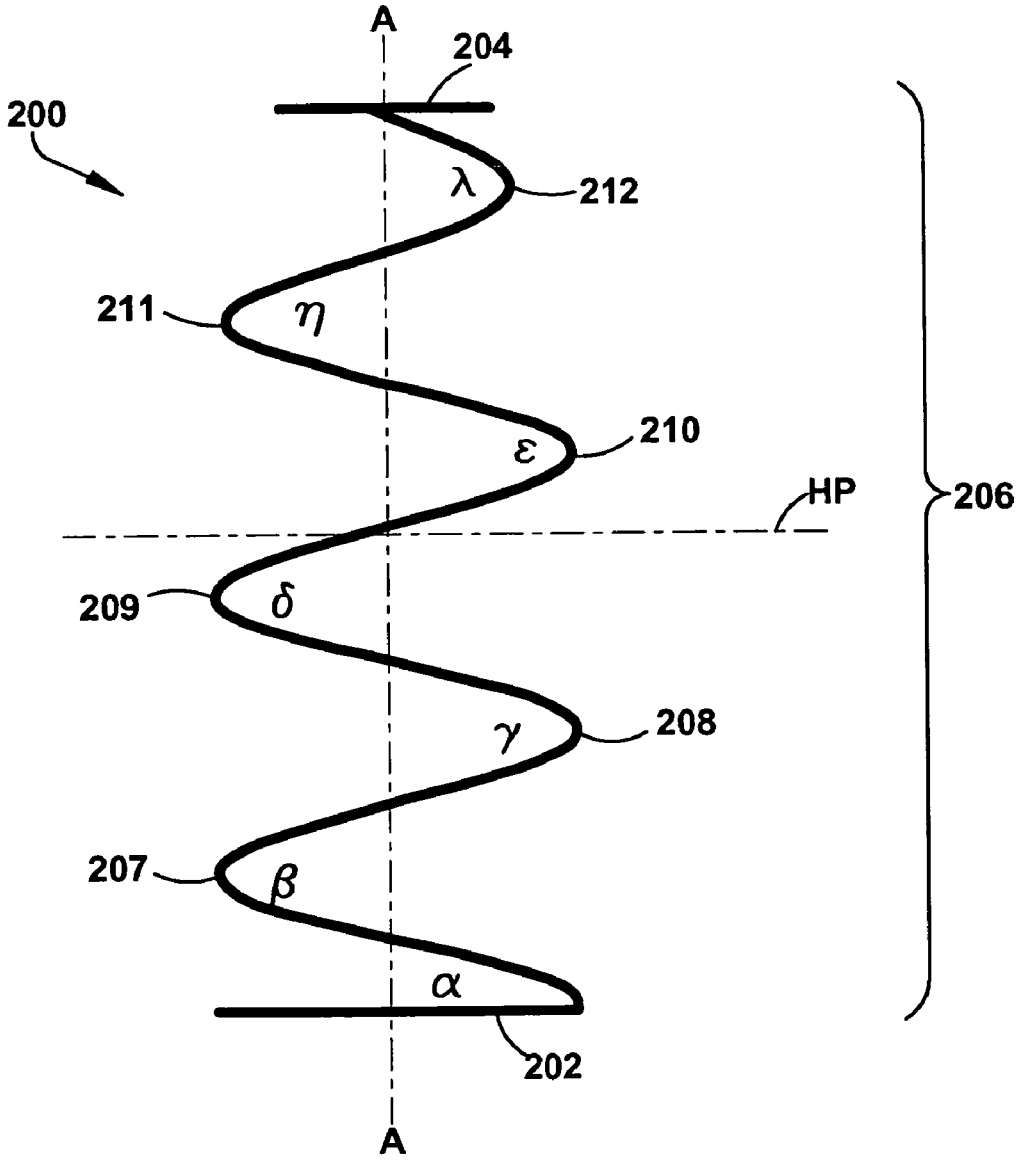
FIG. 2A is a profile view of another asymmetric spring component of the present invention.
Figure 2B:
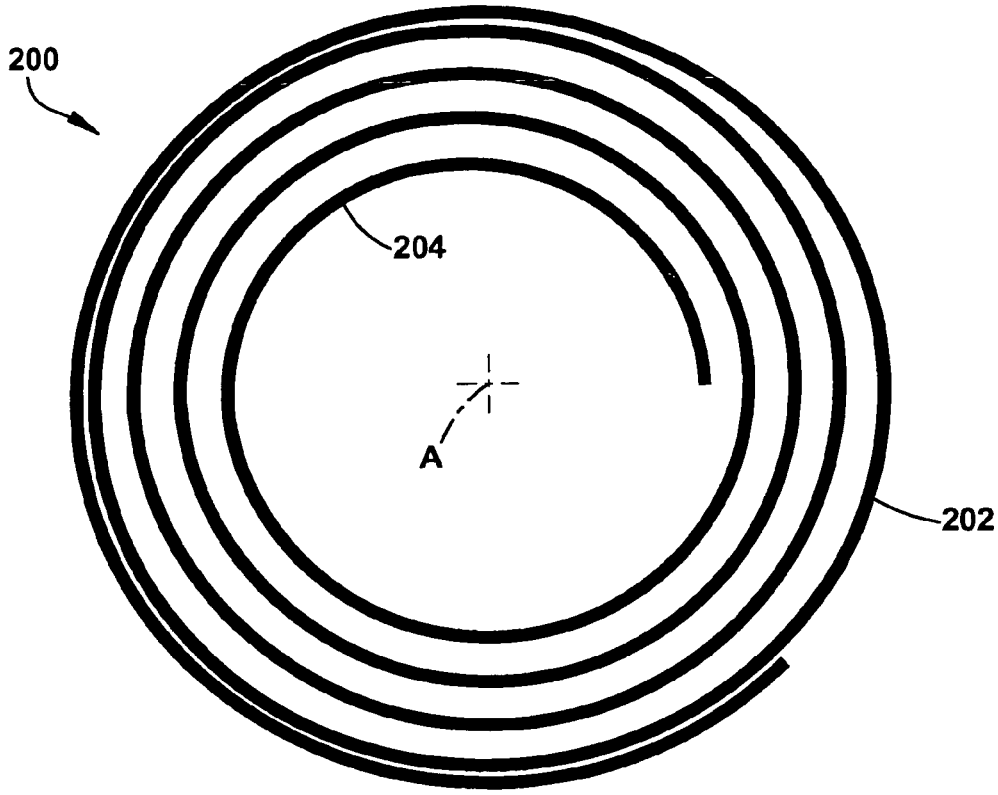
FIG. 2B is an end view of the asymmetric spring component of FIG. 2A.

FIGS. 2A and 2B illustrate an alternate embodiment of an asymmetric spring component of the invention, in the form of a coil spring 200, in which the turns of the body 206 of the coil are asymmetric about a horizontal reference plane HP through the axis A of the coil body 206, but have generally equal radius and diameters, as shown in FIG. 2B. Turns of equal diameter produce a coil which has good lateral stability, while the asymmetry along the length of the coil body, as produced by the varying pitch angles $\alpha$–$\lambda$ creates a softer feel in the upper region of turns 209–212, and uses less material in the lower region of the coil body, turns 207–208. The upper and lower regions of the asymmetric spring coils of the invention are generally defined as those regions comprised of the turns of the coil body which are closest or proximate to the support end and top end of the coil, respectively, or which are on opposite side of the reference plane HP which passes through the axis A of the coil spring. In asymmetric coil springs of the invention wherein there is a difference in the number, pitch angle or radius of turns of the coil body on one side to the other of the reference plane HP, the asymmetric coil spring thus has a first configuration on one side of the reference plane and a second configuration on another side of the reference plane, the first configuration being different than the second configuration.

Figure 3A:
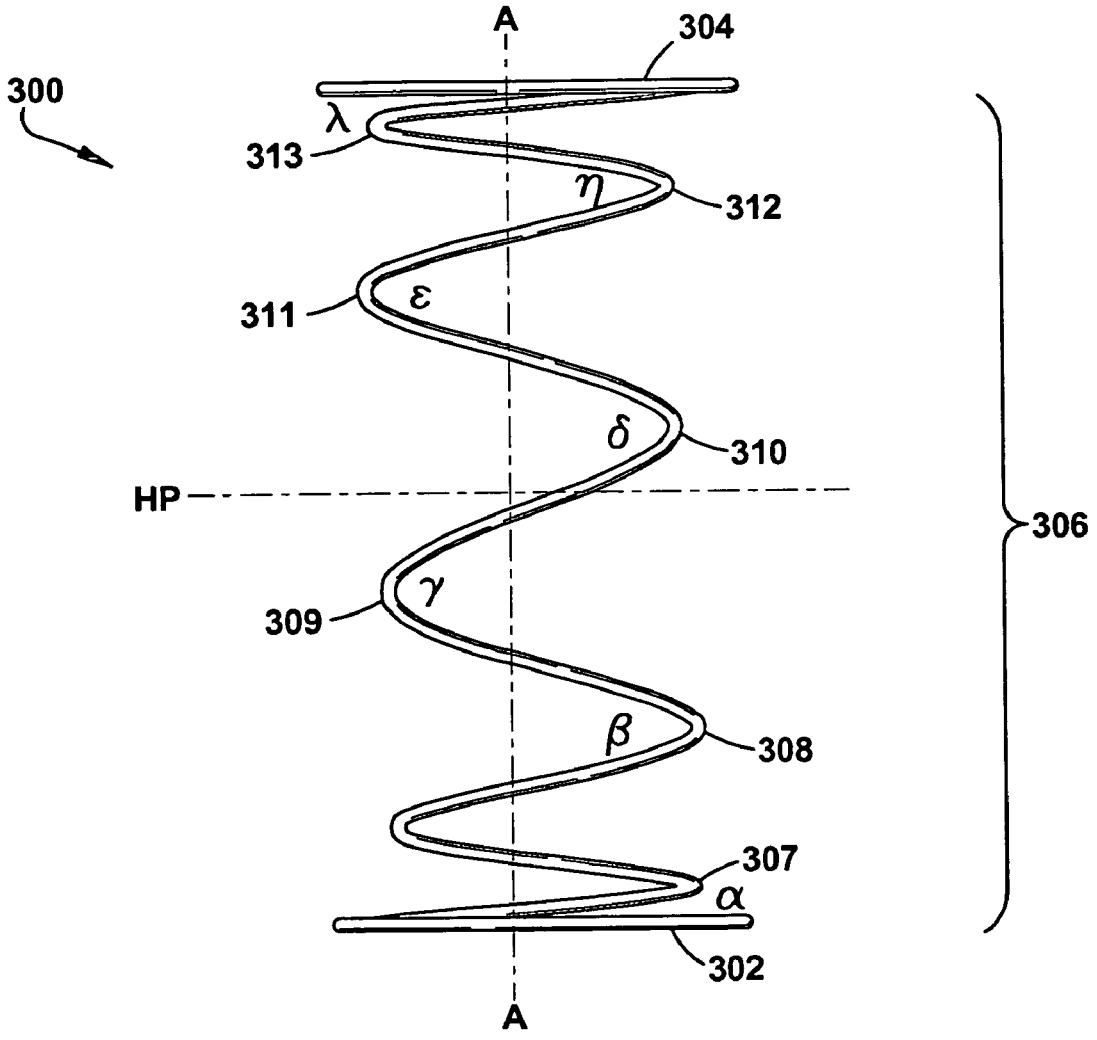
FIG. 3A is a profile view of an asymmetric coiled wire spring with offset ends.
Figure 3B:
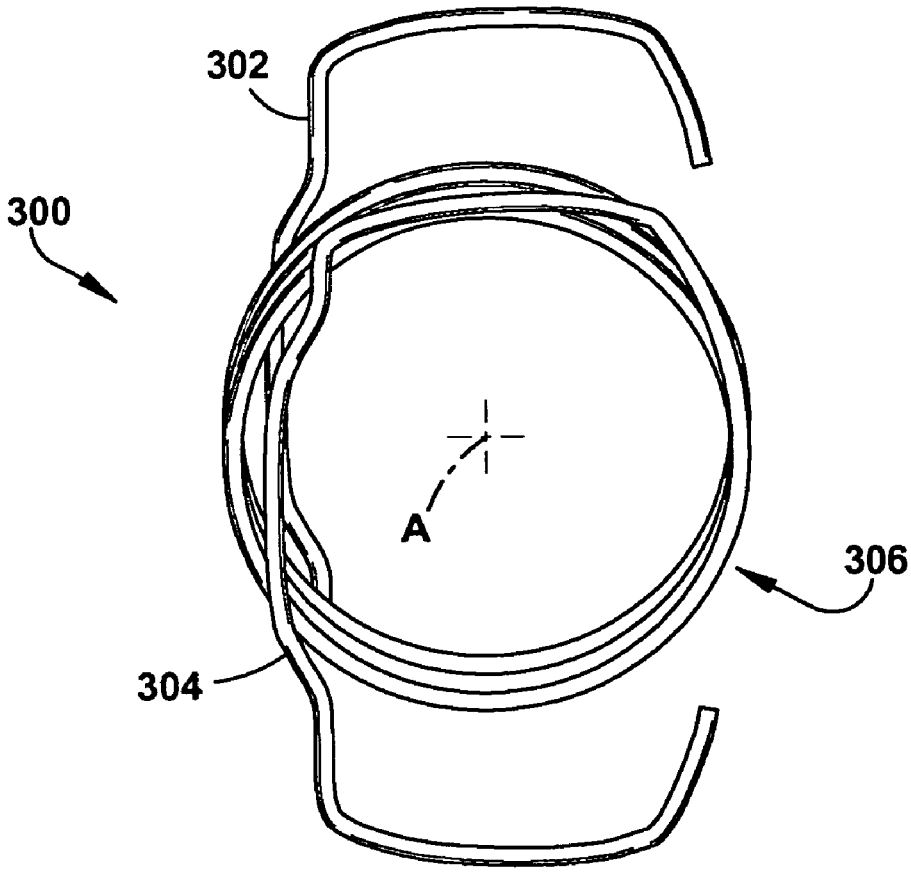
FIG. 3B is an end view of the asymmetric coil of FIG. 3A.

FIGS. 3A and 3B illustrate an alternate embodiment of an asymmetric coil spring of the invention, such as a wire form coil generally indicated at 300, wherein a largest turn 310 of the body 306 of the coil is located in an upper region of the coil, nearer to the top 304 than to the base or bottom 302. The coil 300 therefore is not symmetric about a horizontal reference plane HP taken through a point or midpoint of the coil body axis A due to the location of the largest turn 310. The relatively large diameter of turn 310 contributes to a lower spring rate and softer feel to the coil 300. The coil body 306 also has at least one next largest turn (e.g. turns 309 and 311) in the upper and lower regions of the coil body 306 proximate to the largest turn 310. These secondary turns of lesser diameter also increase the spring rate in those regions of the coil body. Also as shown, the pitch angle $\gamma$ at turn 309 may be somewhat greater than pitch angle $\epsilon$ at turn 311 in order to further increase the spring rate and resultant stiffness in the lower base region of the coil, and to reduce the amount of wire material required to form the coil spring. The pitch angles at turns 307, 308 and 312, 313 are progressively smaller moving toward the terminal ends of the coil to lower the spring rate for a softer feel. This is particularly desirable at the support top end 304 for use in an innerspring which has a soft initial feel with a gradually increasing spring rate as the coil is compressed, and which articulates in response to off-axis loads. The larger pitch angles in a central region of the coil body reduces the total amount of wire or other material used to form the coil as compared to a coil which is symmetric. The asymmetric coil designs and innersprings of the invention therefore have a lower production cost, and result in a lower total cost to manufacture a one-sided mattress with asymmetric spring components.

Figure 4A:
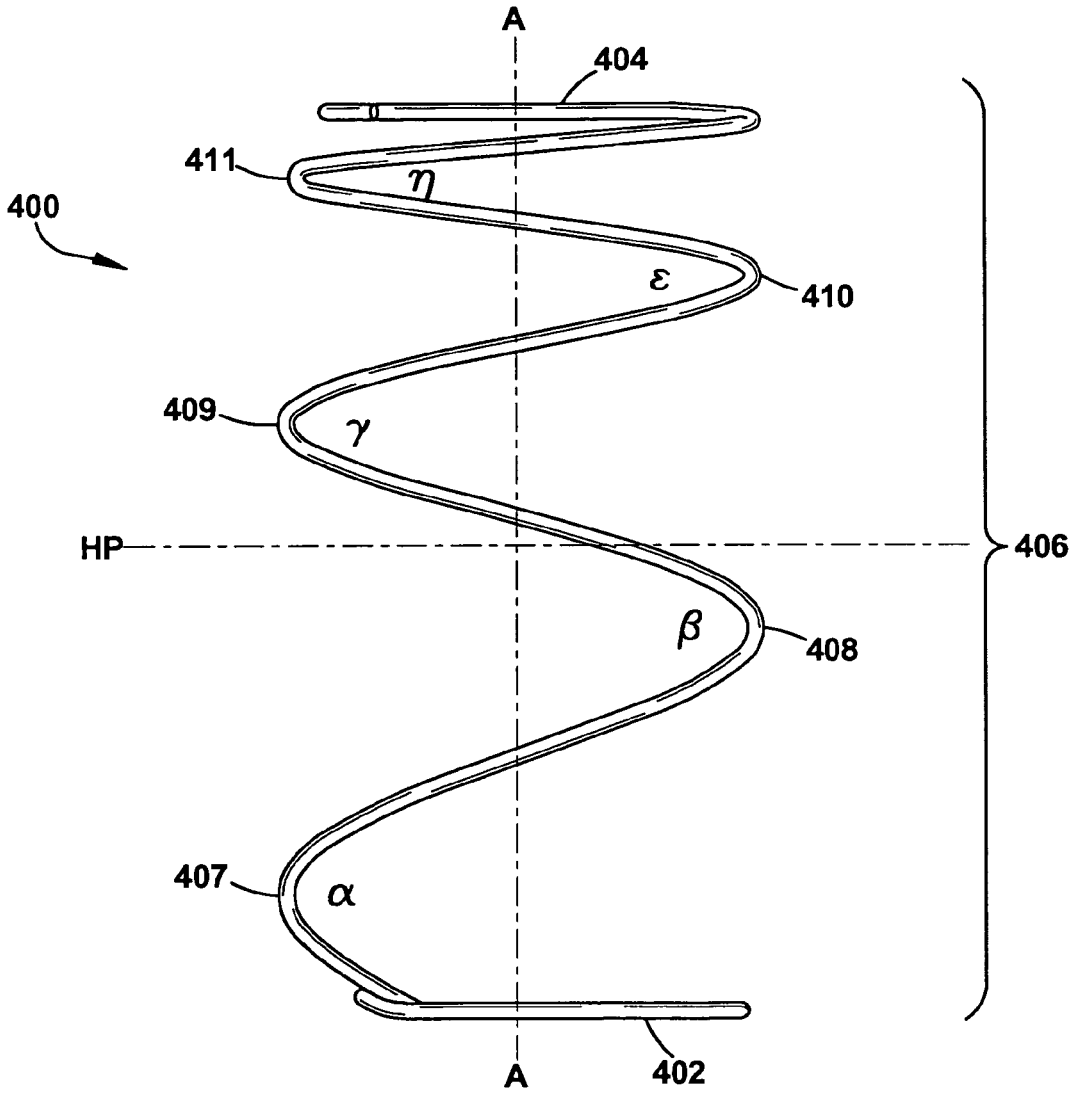
FIG. 4A is a profile view of an asymmetric spring component of the present invention in the form of a coiled wire spring with offset ends.
Figure 4B:
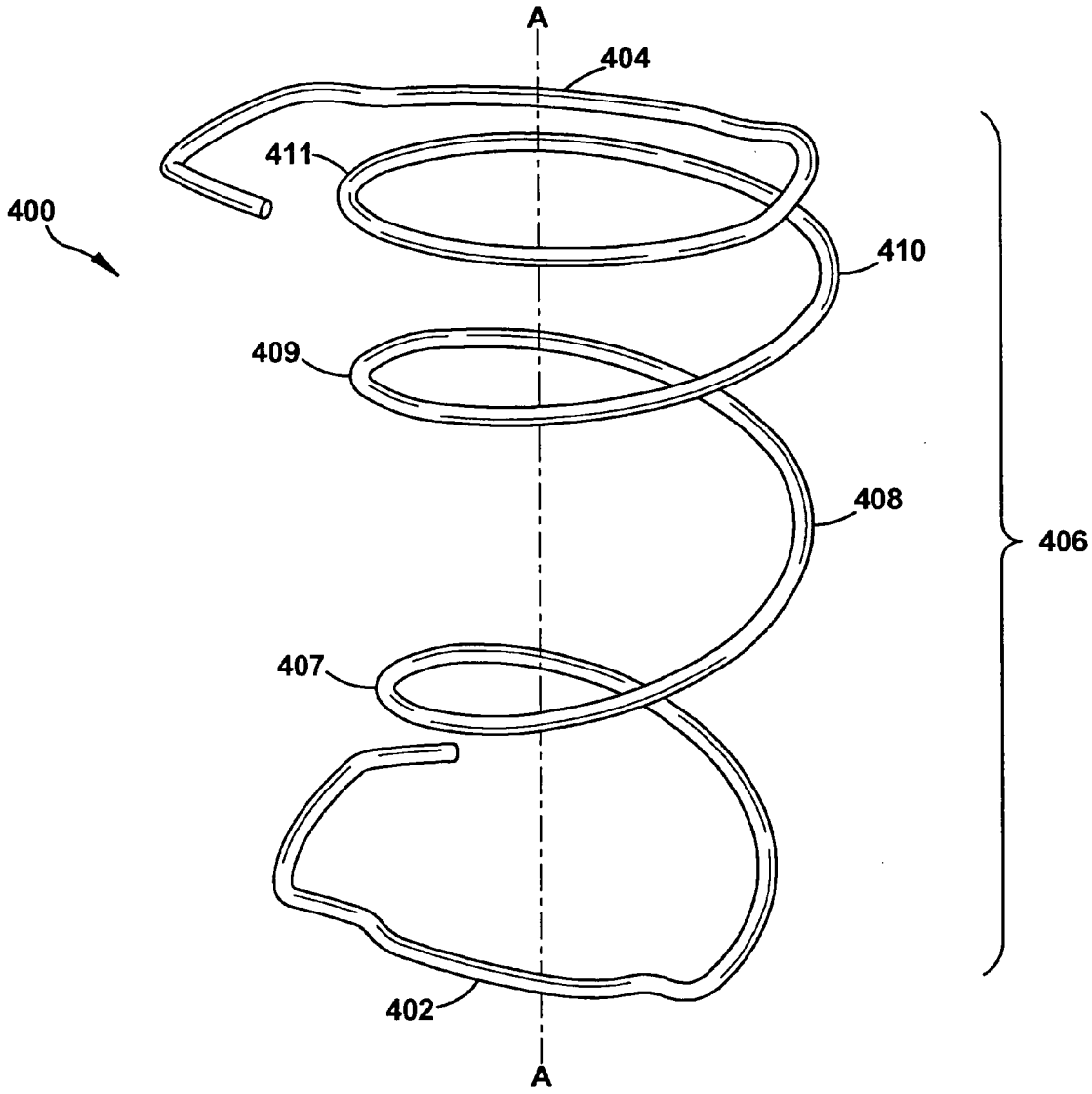
FIG. 4B is a perspective view of the asymmetric spring component of FIG. 4A.
Figure 4C:
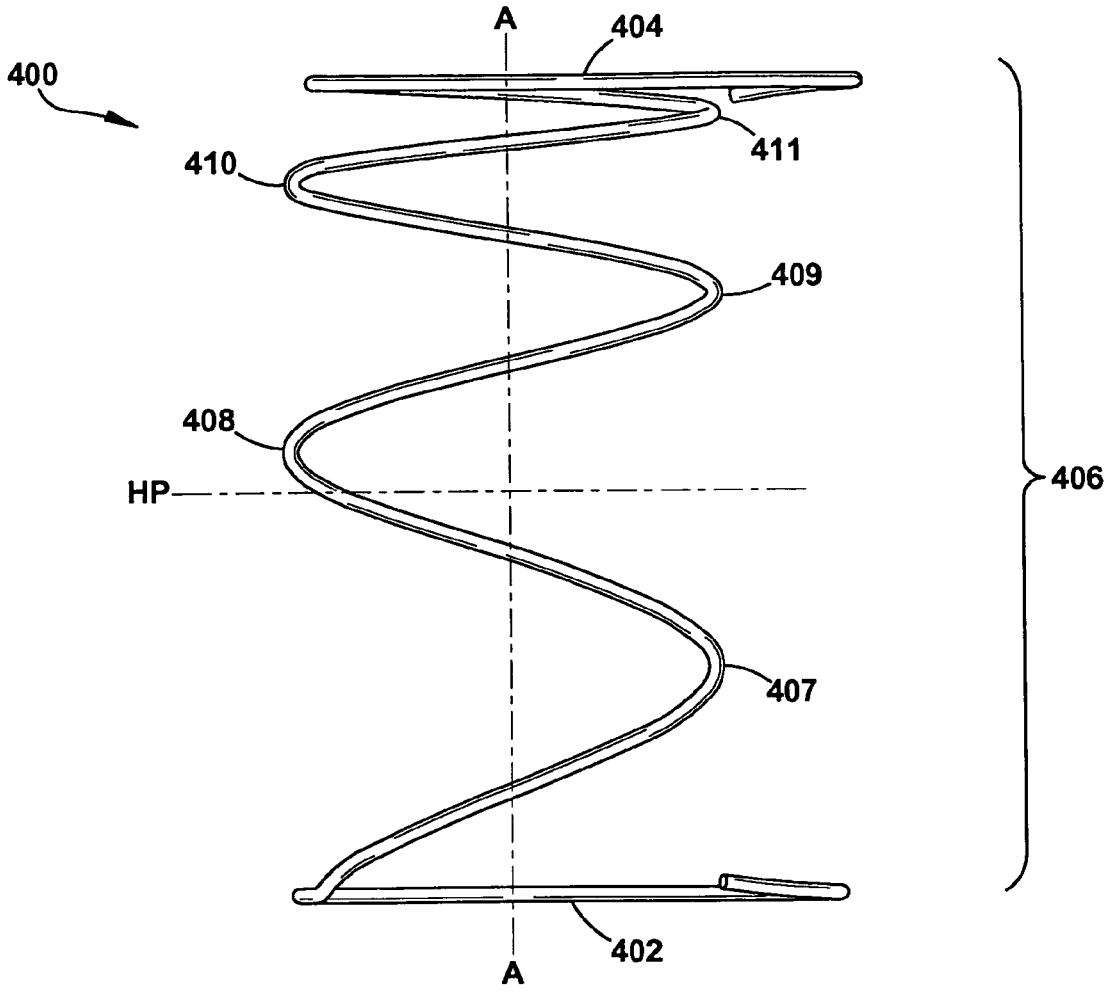
FIG. 4C is an alternate profile view of the asymmetric spring component of FIG. 4A.
Figure 4D:
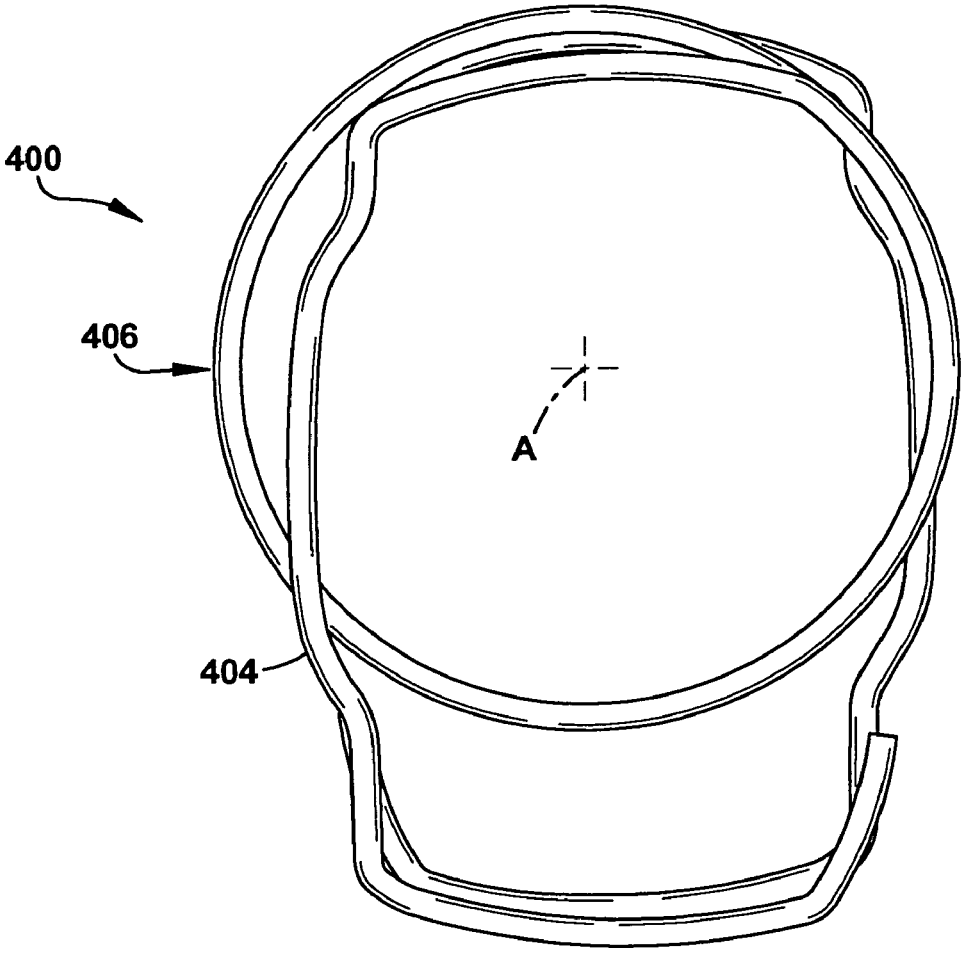
FIG. 4D is an end view of the asymmetric spring component of FIG. 4A.
Figure 5A:
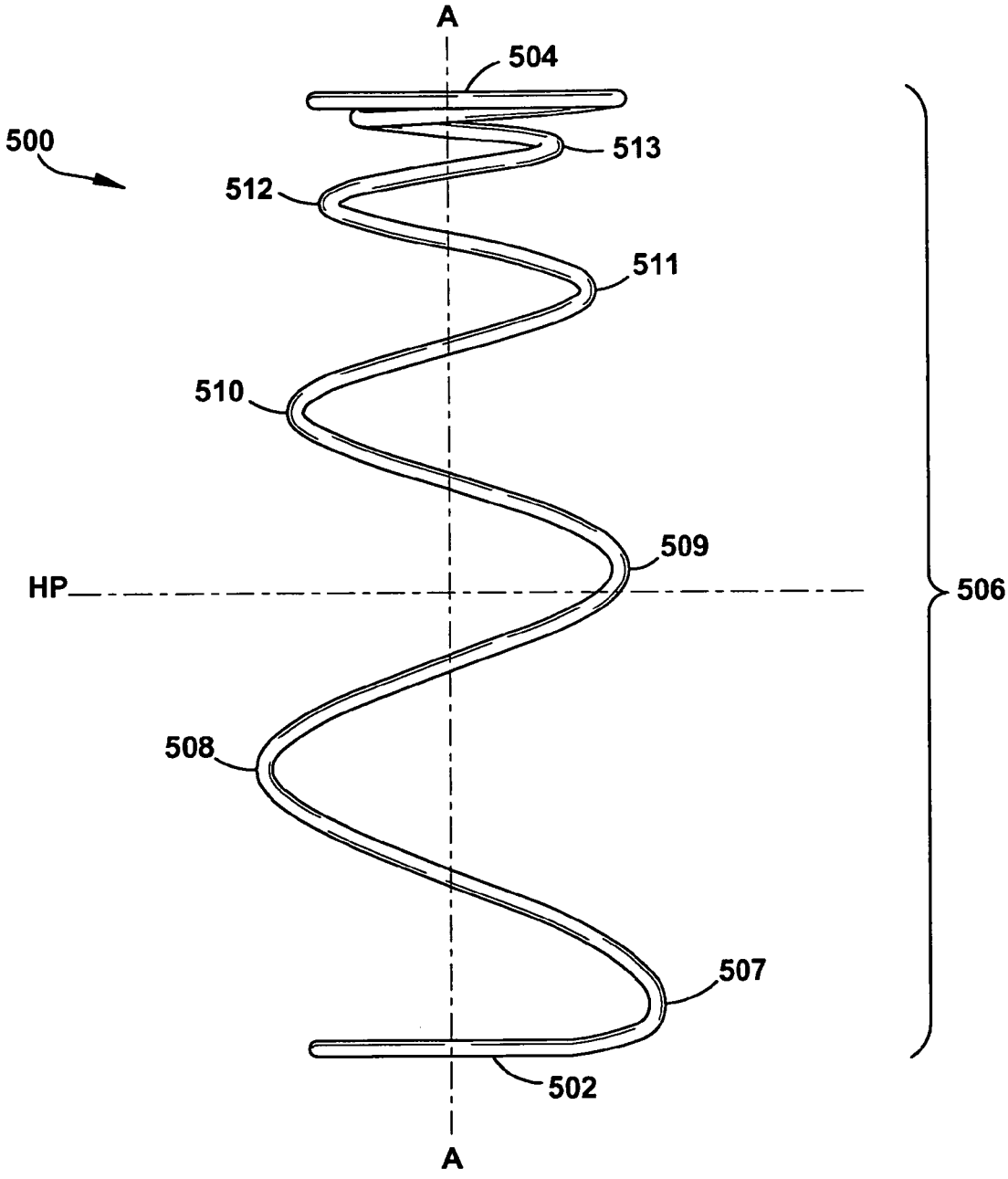
FIG. 5A is a profile view of an alternate embodiment of an asymmetric spring component of the present invention in the form of a coiled wire spring with offset ends.
Figure 5B:
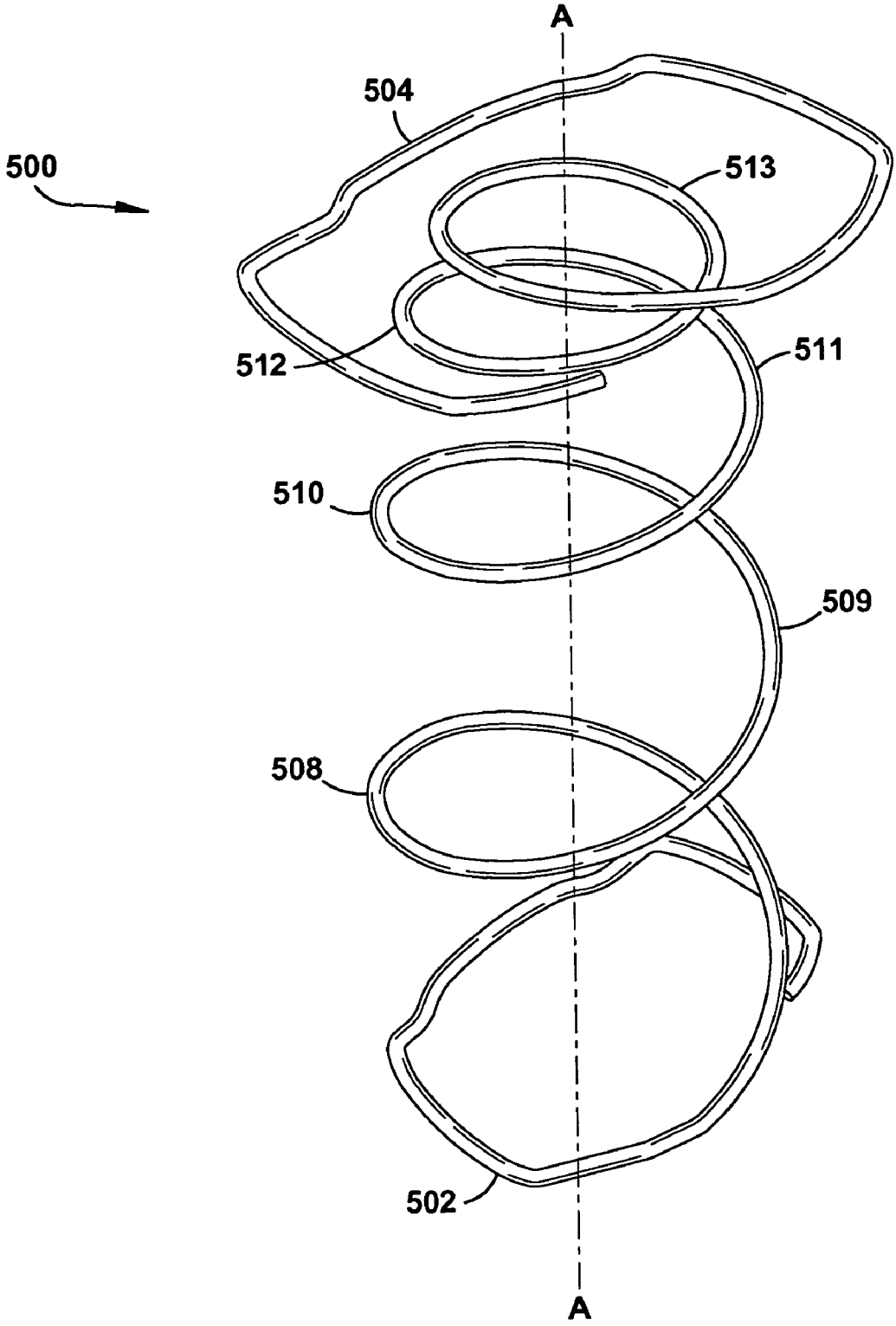
FIG. 5B is a perspective view of the asymmetric spring component of FIG. 5A.
Figure 5C:
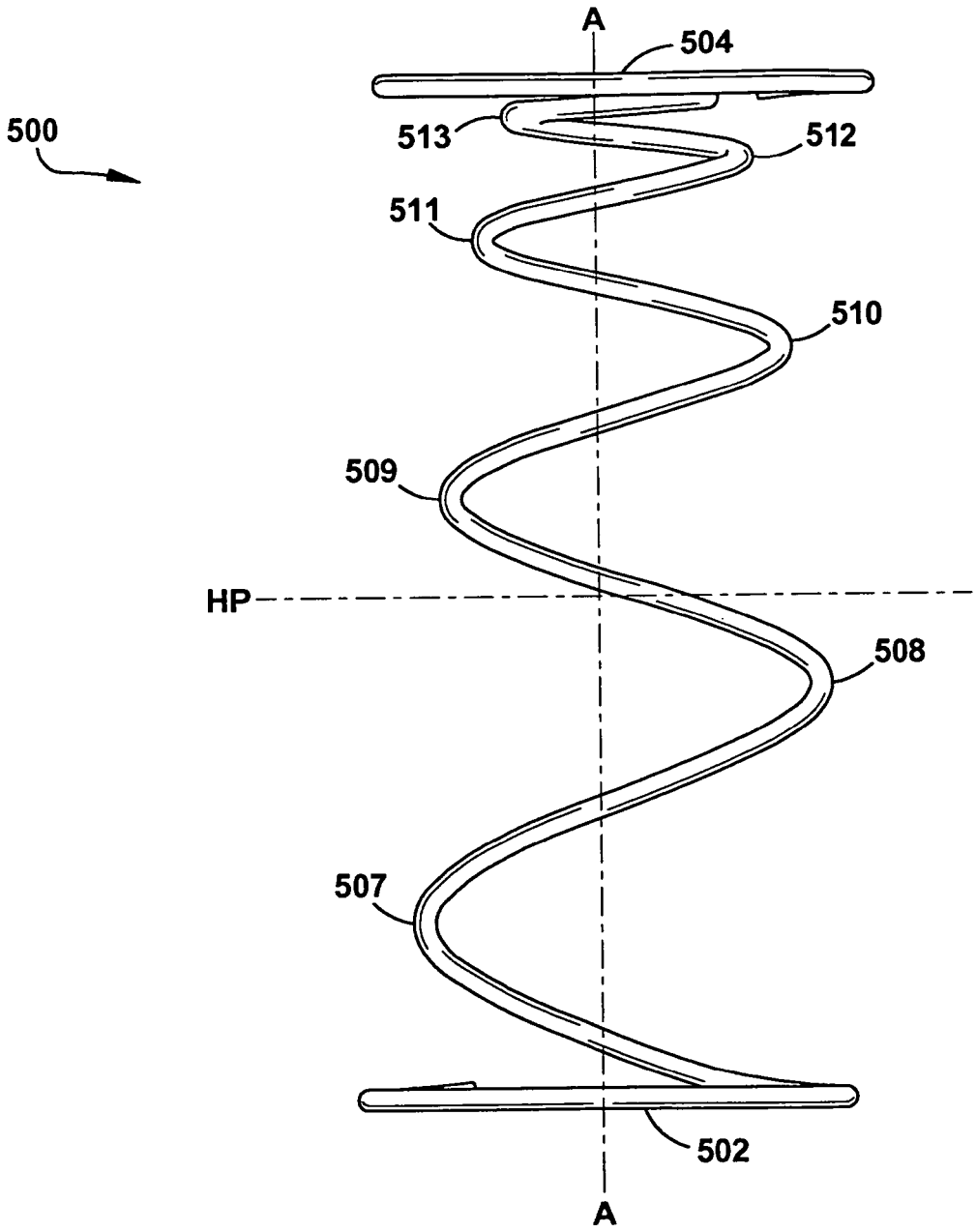
FIG. 5C is an alternate profile view of the asymmetric spring component of FIG. 5A.
Figure 5D:
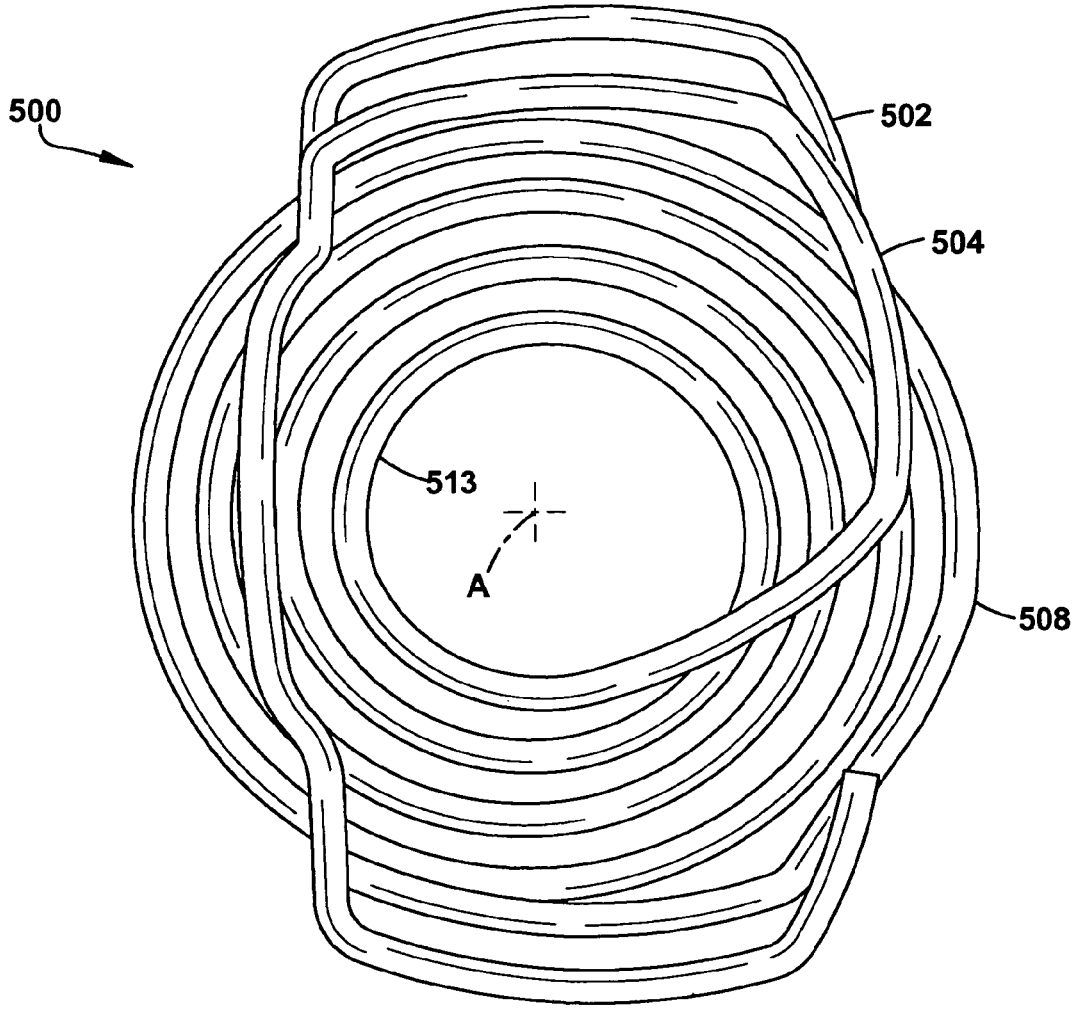
FIG. 5D is an end view of the asymmetric spring component of FIG. 5D.

FIGS. 4A–4D illustrate an alternate embodiment of an asymmetric coil spring 400 of the invention, which may also be manufactured as a wire form coil, wherein turns 407, 408 and the largest pitch angles $\alpha$ and $\beta$ are located in a lower region of the coil body 406, similar to coil spring 100, but with each of the turns 407–411 of substantially equal diameter. The ends 402 and 404 of the coil spring are formed with offsets as shown in FIGS. 4B and 4D which facilitate lacing of multiple coil springs together to form an innerspring assembly as known in the art. The invention, however, provides the novel construction of asymmetric coil springs laced or otherwise combined or arranged together to form an asymmetric innerspring assembly, as further described herein. The termination of ends 402 and 404 of the coil 400 can be on the same side of the coil body 406 as may be desired.

Figure 6:
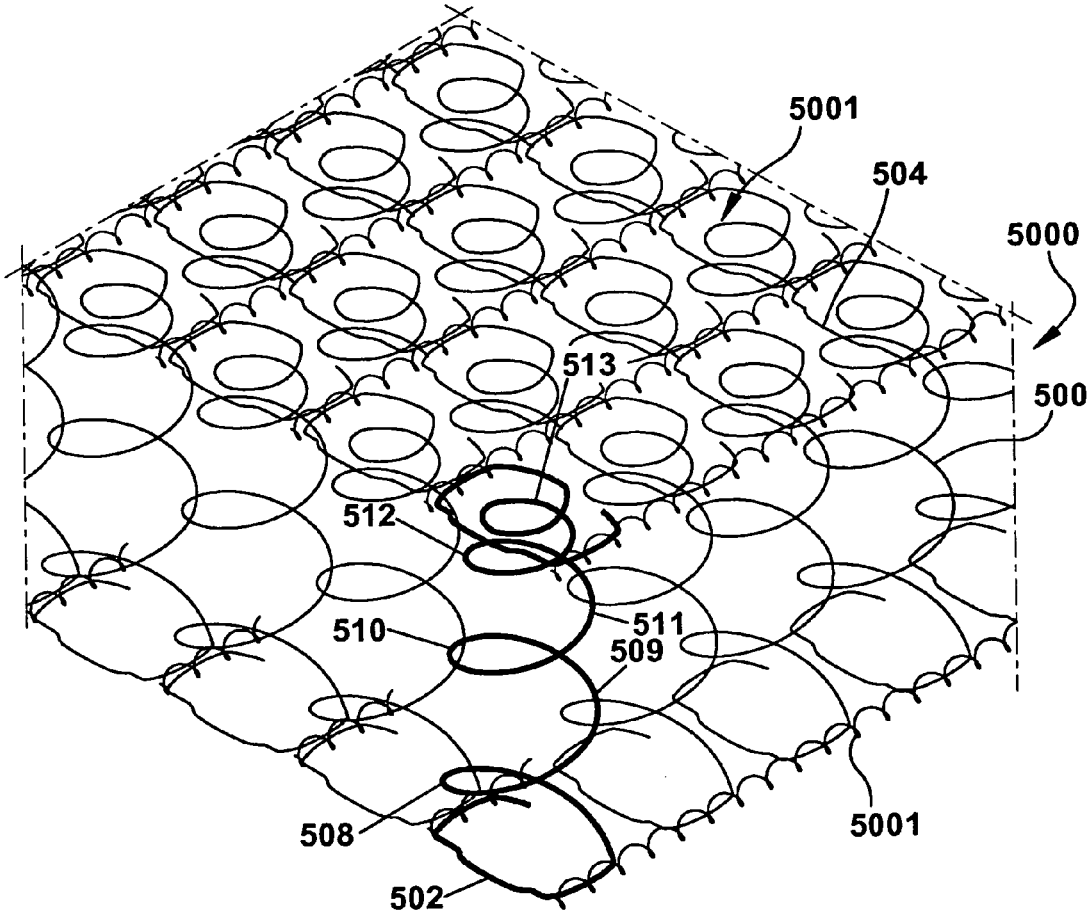
FIG. 6 is a perspective view of a portion of an asymmetric innerspring assembly constructed with asymmetric coil spring components in accordance with the present invention.

FIGS. 5A–5D illustrate an alternate embodiment of an asymmetric coil spring 500 which has both vertical and horizontal asymmetry, that is the shape or configuration of the coil spring 500 is not symmetric about a horizontal plane HP passing perpendicular through an axis A of the coil body 506, and is not symmetric about a vertical plane which passes through the axis A of the coil body 506. As used herein, the description of a coil being "asymmetric" or "not symmetric" means that the configuration of the coil on one side of a reference plane, such as a horizontal reference plane HP, or a vertical reference plane passing through a vertical axis A of the coil body, is different on one side of the plane than on the other. As described, the primary differences in the configuration of the coil on opposite sides of the reference planes are the number of turns, the radii of the turns, the pitch angle of the turns, and the sizes and shapes of the terminal convolutions or ends 502, 504. The turns 507, 508, 509 in the lower region of the coil body 506 (proximate to the coil base 502) have a larger pitch angle and larger radius than the those of the remaining turns 510–513 in the upper region of the coil body 506. This provides a coil spring which has excellent stability in all directions, a relatively stiff lower region owing to the steeper pitch, and a lower spring rate upper region which creates a softer initial feel to an innerspring containing such springs, and enhances articulation of each of the coils for better conformance. The relatively smaller pitch angles of the upper region are combined with the relatively smaller radii. This asymmetry in both horizontal and vertical dimensions allows the coil spring design to be fine tuned to the type of feel and performance desired for any particular application such as a mattress innerspring, furniture or other seating or flexible support. The ends 502 and 504 are shown formed as offset ends for purposes of lacing together in an innerspring assembly, as shown in FIG. 6. The terminations of the coil ends at base 502 and top 504 can be on the same or opposite sides of the coil body 506, and can share the same configuration or not.

FIG. 6 is a perspective view of a portion of an asymmetric innerspring assembly, indicated generally at 5000, which includes a plurality of asymmetric coil springs 500 arranged in a matrix and laced together by helical lacing wires 5001 running in parallel as shown. From this view it is apparent that the upper region of the asymmetric innerspring assembly (proximate to the upper coil ends 504) has a greater density of formed wire material than the lower region (proximate to lower coil ends 502) as a result of the turns of lesser pitch in the upper region of the coil bodies 506. This in combination with the larger radii turns of the coils in the lower region results in an innerspring assembly which has a relatively soft upper region and a relatively stiff lower region. Although the upper coil ends 504 are laced together in the innerspring 5000, they are still able to articulate or move in multiple dimensions in part due to the smaller radii of the upper turns 511–513 of the coils 500. Also apparent in this view is that the configuration of the innerspring 5000 proximate to the upper ends 504 of the coil springs 500 (which is the single support side of the innerspring 5000) is different than the configuration proximate to the lower ends 502 of the coil springs 500. That is, the upper region of the innerspring 5000, made up of the upper regions of the coil springs 500 including turns 510–513, is not symmetric with a lower region of the innerspring made up of the lower regions of the coil springs 500 including turns 507, 508. Therefore, the asymmetric innerspring 5000 is ideally suited for use in a one-sided mattress with the upper ends 504 of the coil springs forming the single support surface 5001 of the one-sided asymmetric innerspring 5000.

The inventive concept of asymmetric spring components and an asymmetric innerspring with a single support side is producible in different forms, including pocketed coil spring innersprings, wherein each asymmetric coil spring is individually encapsulated in an enclosure such as a shell or pocket or encasement made of fabric or non-woven or other flexible material.

Figure 7A:
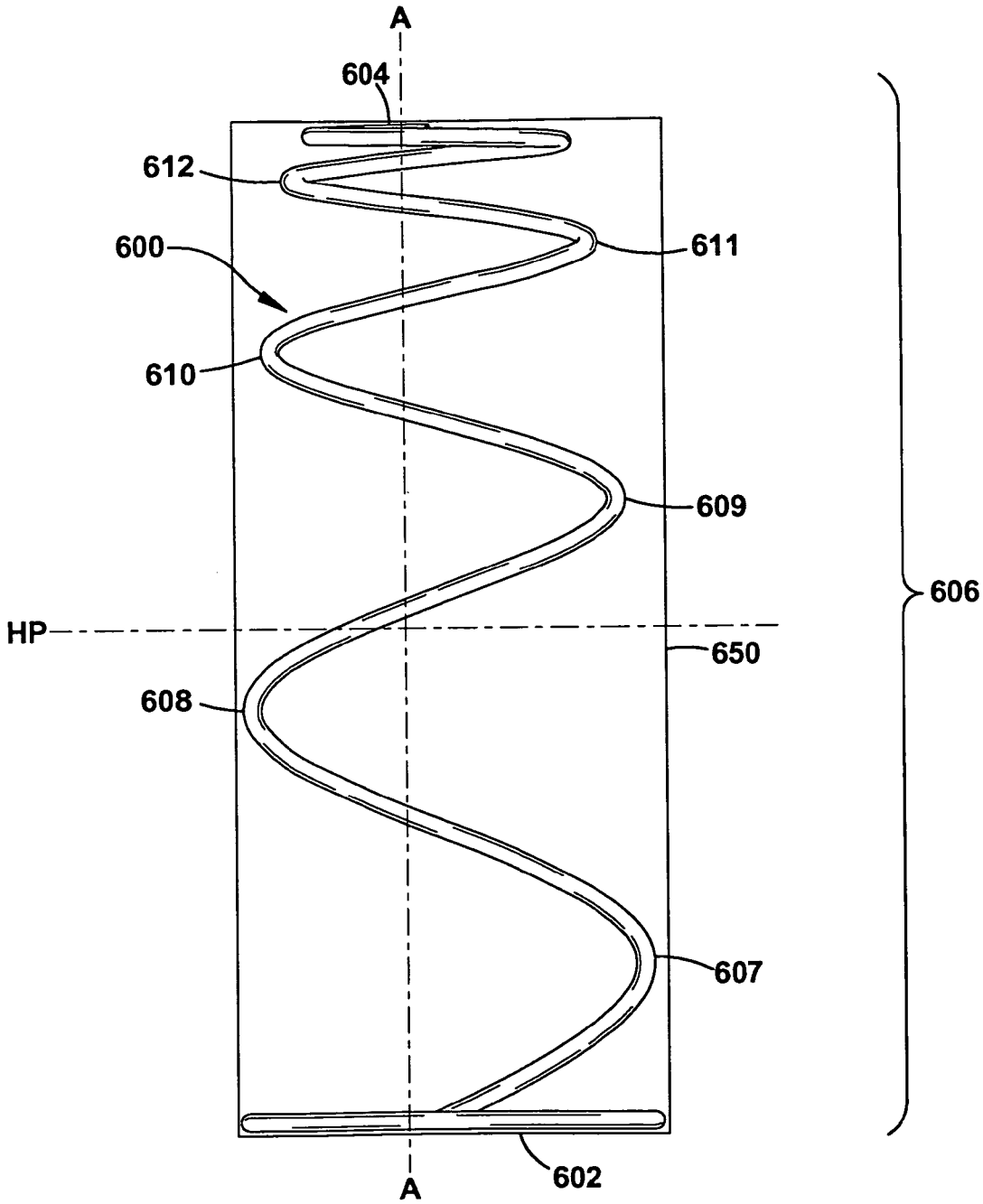
FIG. 7A is a profile view of an asymmetric spring component of the present invention in the form of a coiled wire spring in combination with a cover or other encasement, also referred to as a pocketed asymmetric spring component.
Figure 7B:
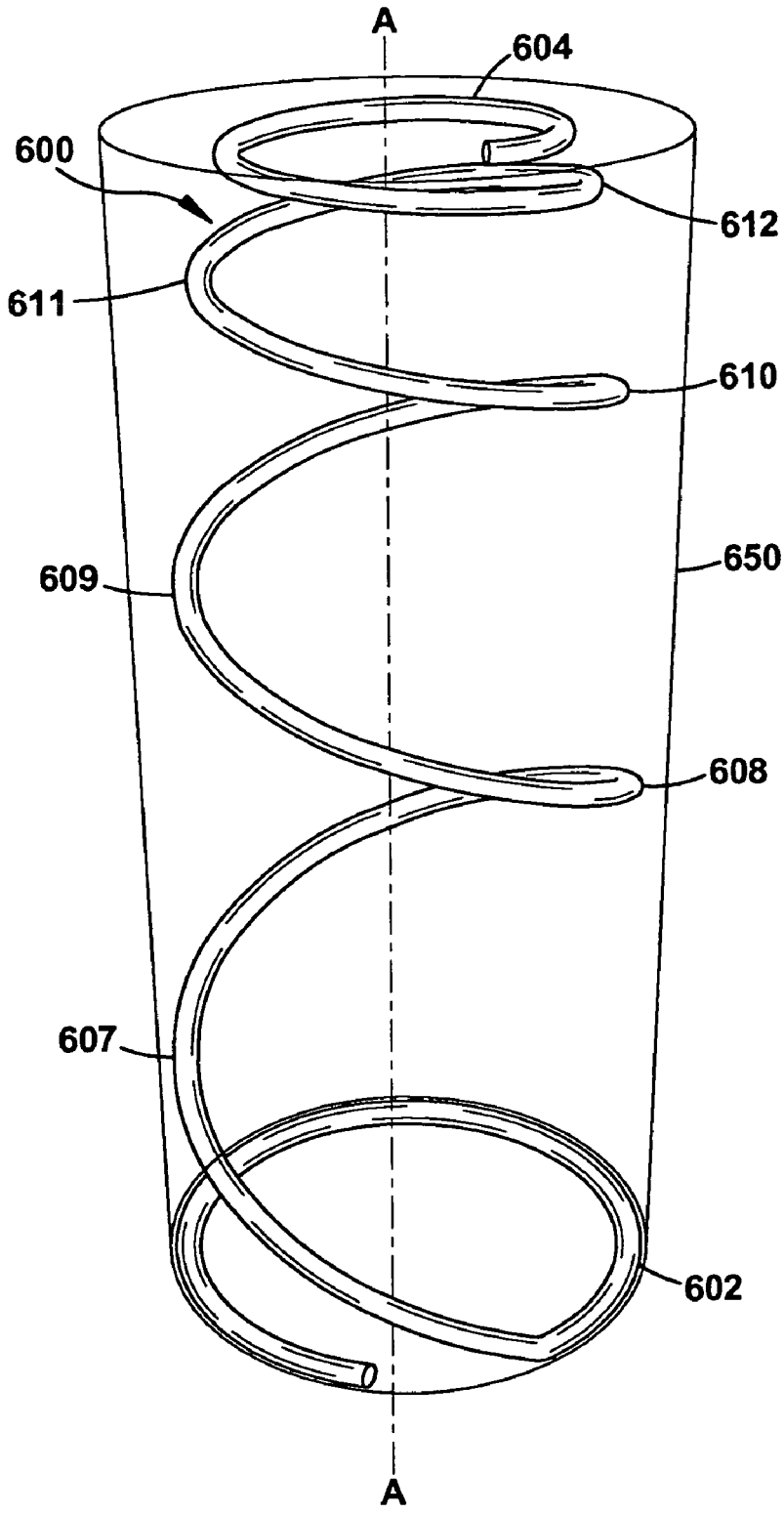
FIG. 7B is a perspective view of the pocketed asymmetric spring component of FIG. 7A.
Figure 7C:
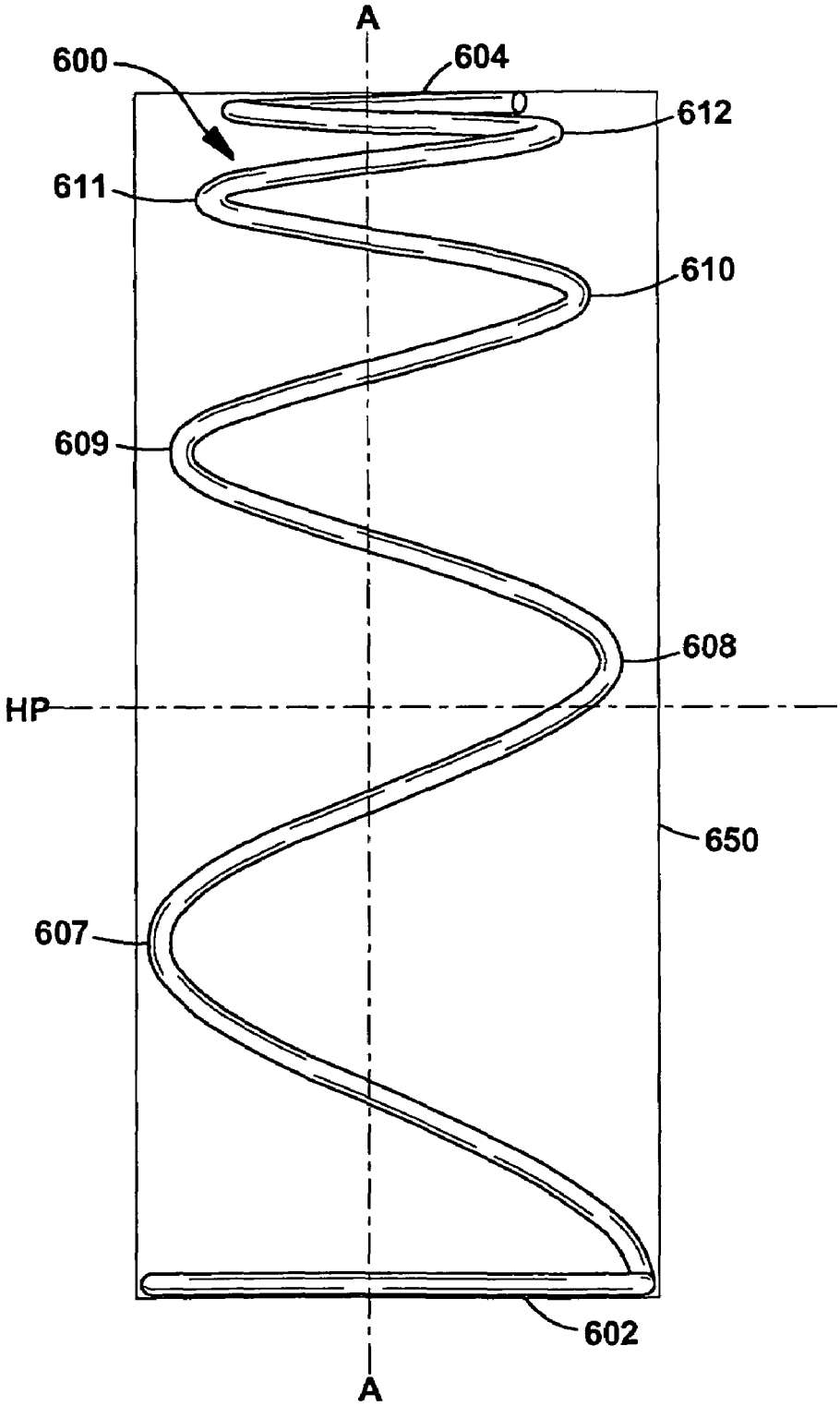
FIG. 7C is an alternate profile view of the pocketed asymmetric spring component of FIG. 7A.
Figure 7D:
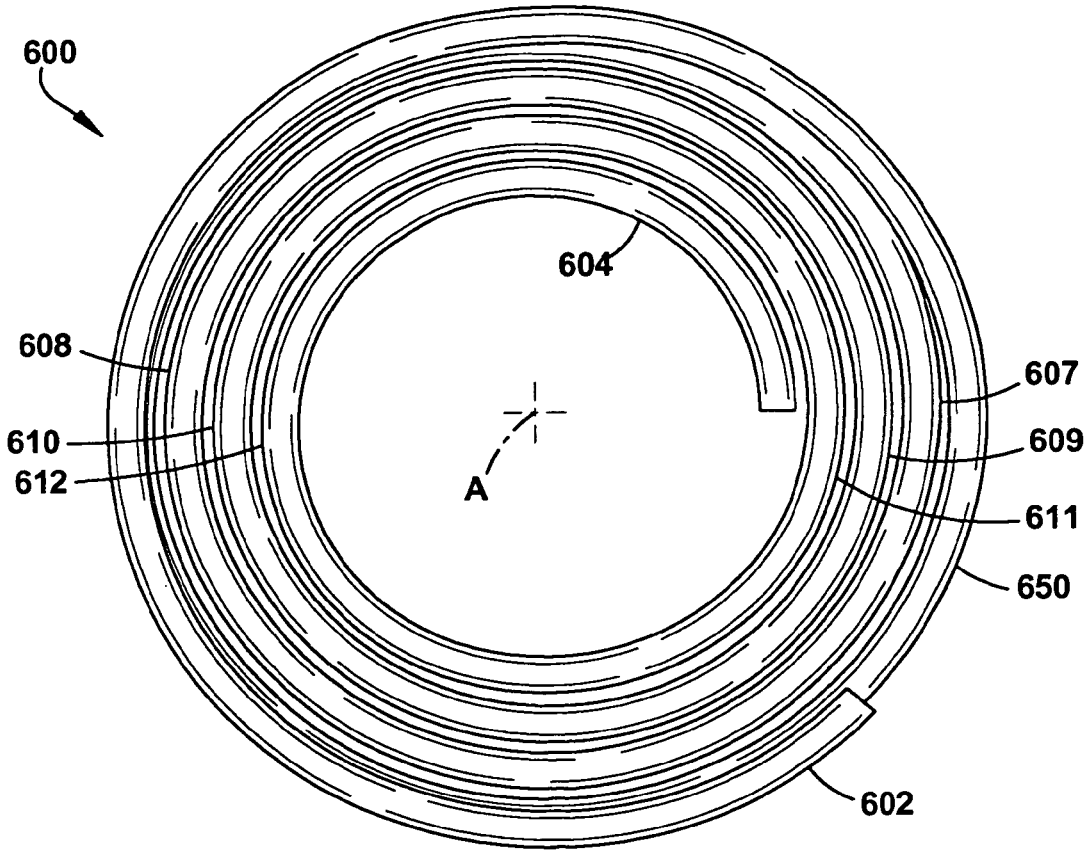
FIG. 7D is an end view of the pocketed asymmetric spring component of FIG. 7A
Figure 7E:
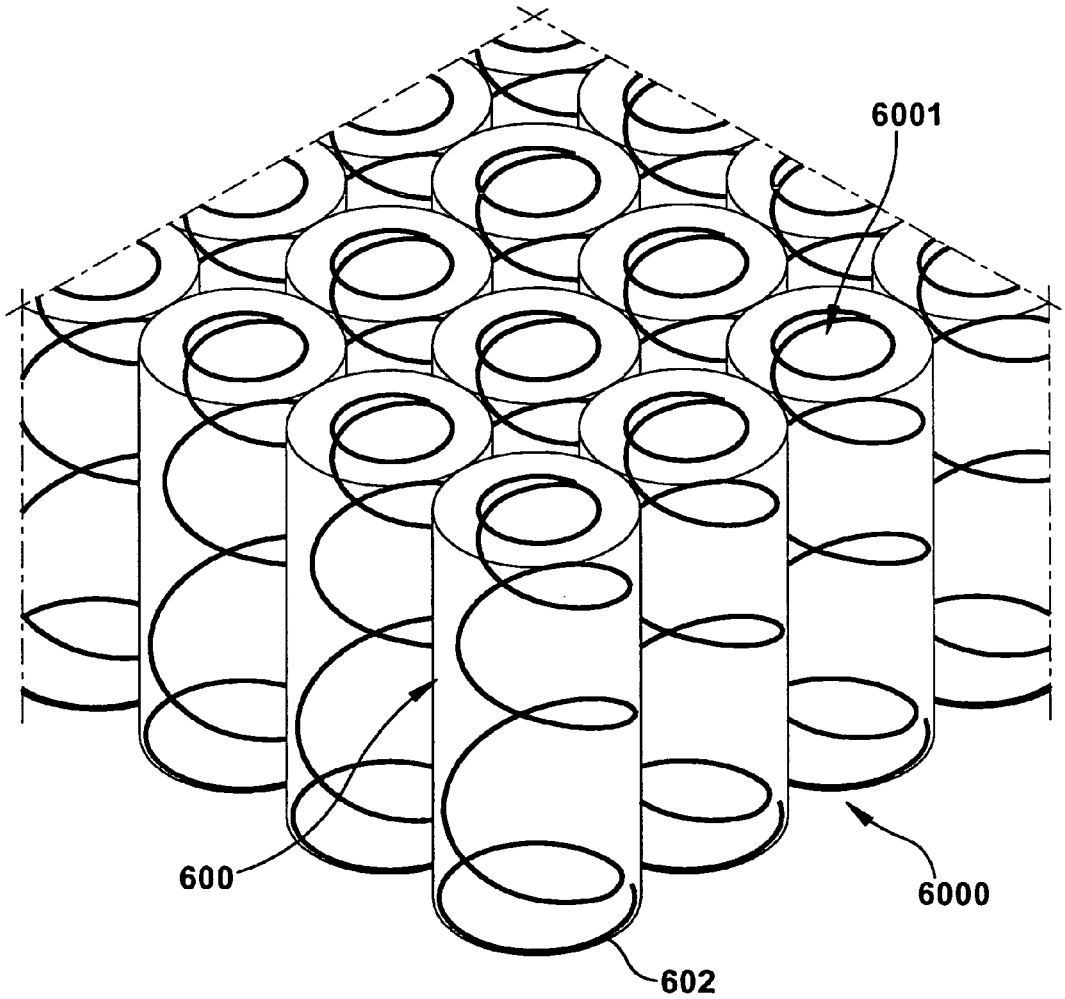
FIG. 7E is a perspective view of an asymmetric innerspring constructed with a plurality of pocketed asymmetric spring components of FIG. 7A, also referred to as a pocketed asymmetric innerspring or pocketed innerspring assembly.

FIGS. 7A–7D illustrate an alternate embodiment of a pocketed asymmetric coil spring 600 of the invention encapsulated in a pocket, package, casing, housing, containment or encapsulation 650, for example in the manner of a Marshall type coil, wherein coils are enclosed within an enclosure made or fabric or non-woven or other material which encapsulates each individual coil spring 600, and serves to maintain multiple coil springs in an array or alignment to form an asymmetric innerspring 6000, as shown in FIG. 7E, which has a single support side 6001 formed by the co-planar arrangement of the support ends 604 of coil springs 600, for use in a one-sided mattress, with the support side 6001 of the innerspring underlying and proximate to the single support side of the mattress. Because the enclosure for each coil spring is generally formed as a cylindrical tube of fabric or other flexible material as known in the art, the general cylindrical or conical shape of the various embodiments of the asymmetric coil springs of the invention are ideally suited for such encapsulation, without losing any of the described benefits of variable diameter and pitch in the coil design for spring rate and feel, and the savings of wire material in the manufacture of the coil springs. Also, to the extent that the coil springs are designed to articulate about smaller diameter or lower pitch turns, the extent of articulation is controlled by the pocket encapsulation 650. As shown in FIG. 7E, the ends 602, 604 of the coil springs 600 are preferably circular in form. Because of the pocket encapsulation, the ends 602, 604 need not be formed with offsets for purposes of lacing the springs together. The asymmetric coil springs of the invention are therefore ideally suited for use in the pocketed coil or Marshall type innerspring.

Figure 8A:
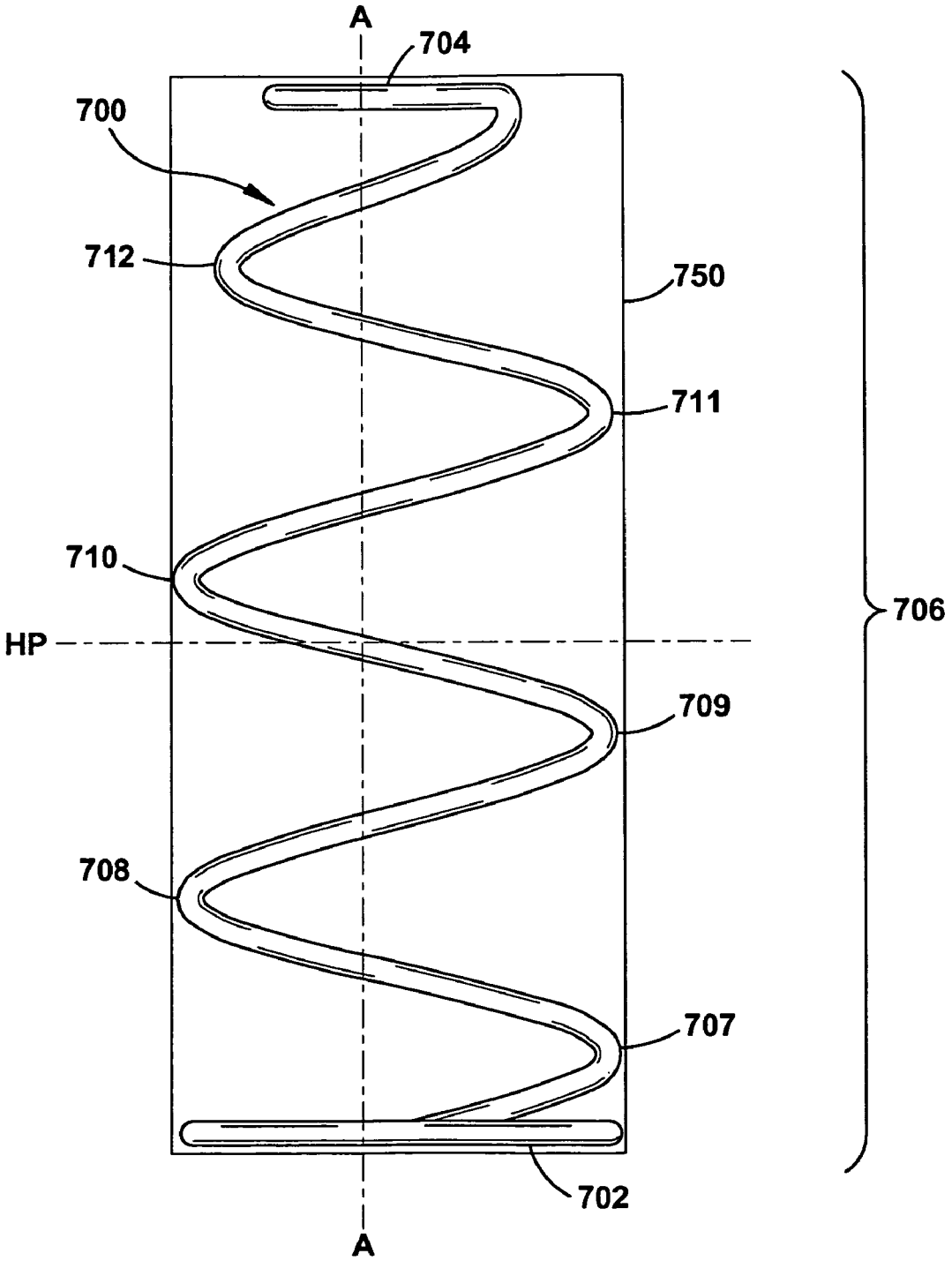
FIG. 8A is a profile view of an alternate embodiment of an asymmetric spring component of the present invention in the form of a coiled wire spring in combination with a cover or other encasement, also referred to as a pocketed asymmetric spring component.
Figure 8B:
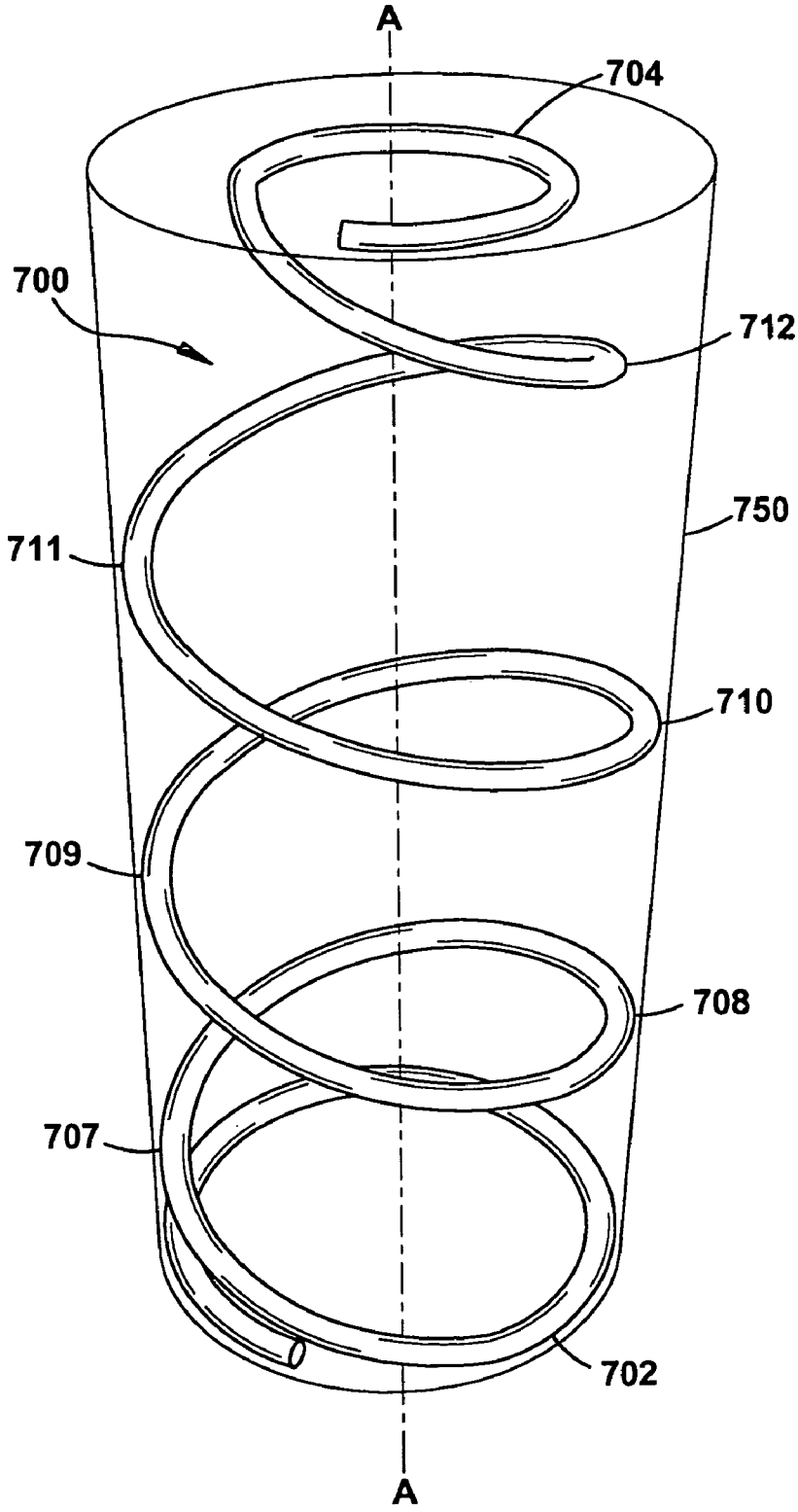
FIG. 8B is a perspective view of the pocketed asymmetric spring component of FIG. 8A.
Figure 8C:
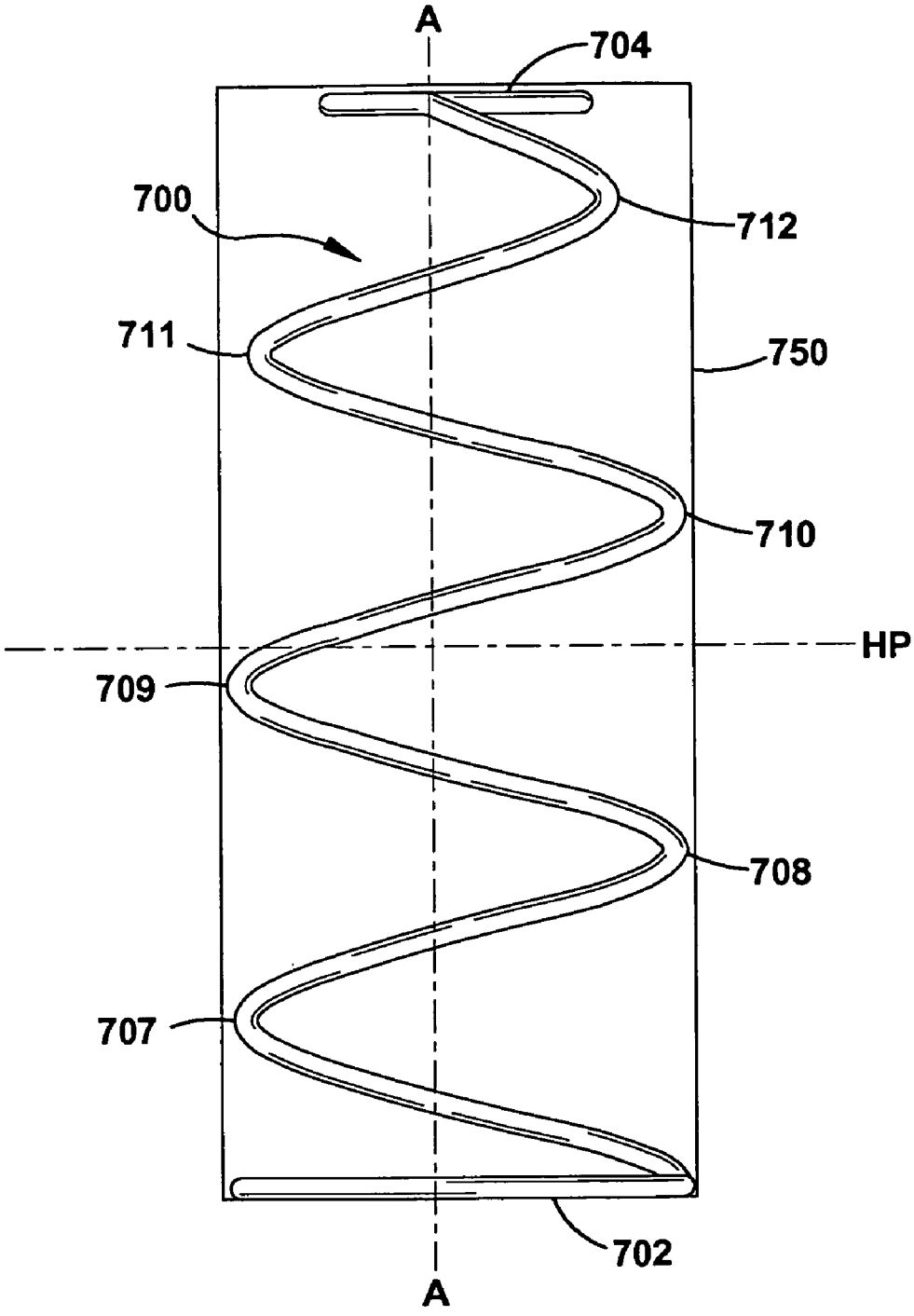
FIG. 8C is an alternate profile view of the pocketed asymmetric spring component of FIG. 8A.
Figure 8D:
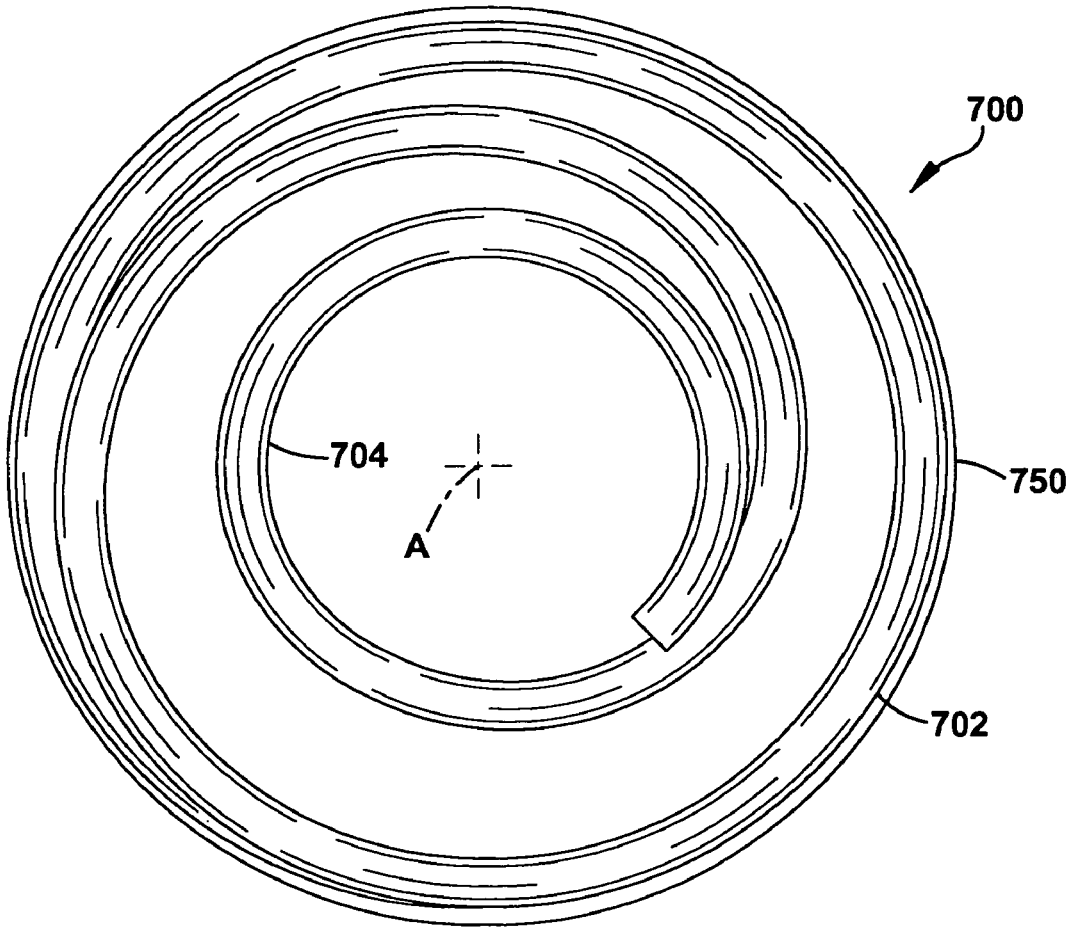
FIG. 8D is an end view of the pocketed asymmetric spring component of FIG. 8A.
Figure 8E:
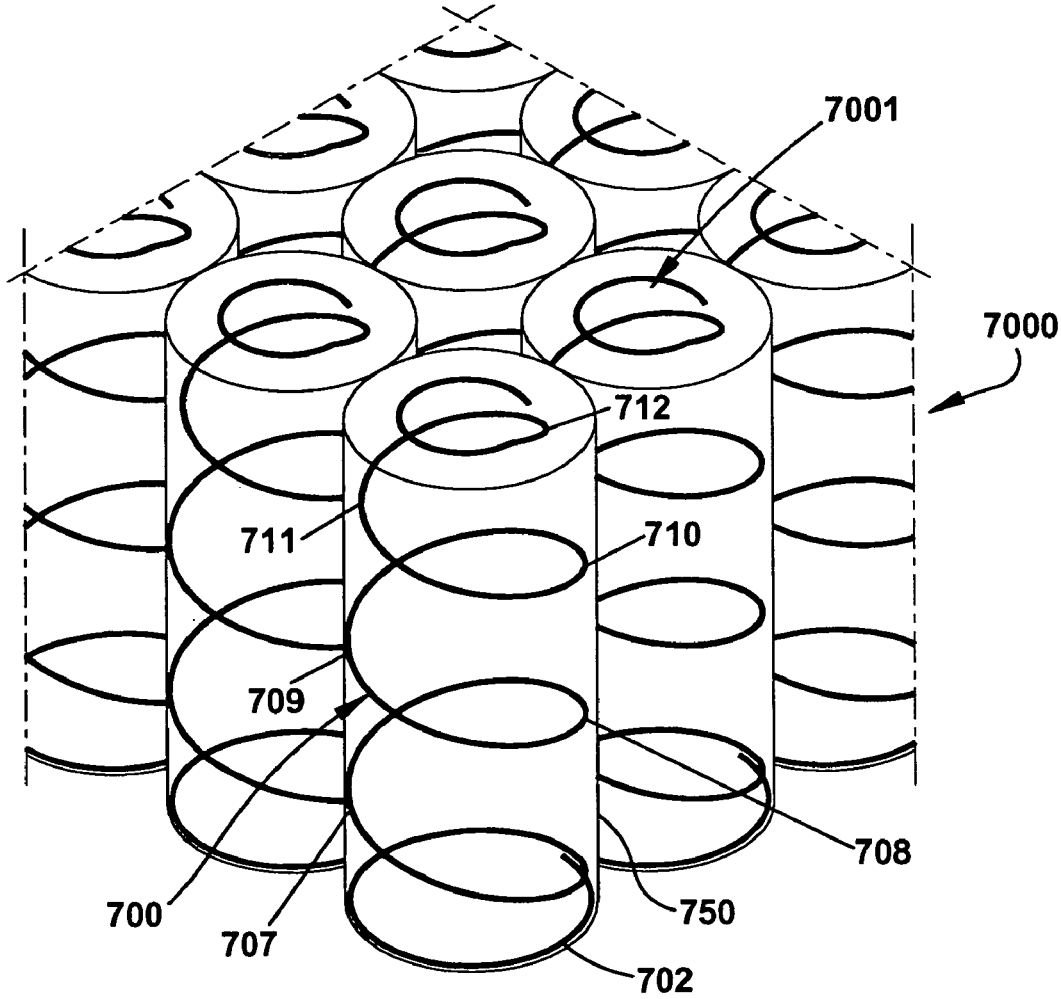
FIG. 8E is a perspective view of an asymmetric innerspring constructed with a plurality of pocketed asymmetric spring components of FIG. 8A, also referred to as a pocketed asymmetric innerspring or innerspring assembly.

FIGS. 8A–8D illustrate an alternate embodiment of an asymmetric coil spring 700 of the invention which is also suitable for use as a pocketed coil, as shown in enclosure 750. In comparison to coil spring 600, the pitch angles of the turns 707–712 are relatively more uniform, particularly in a lower region of the coil spring, and of generally equal radius. Coil springs with turns of larger and equal radii can be used in a pocketed asymmetric innerspring without concern over interference between the turns of the springs, and still have the advantages of variable pitch and radius. FIG. 8E illustrates an asymmetric innerspring 7000 with a single support side 7001, formed by the co-planar arrangement of the support ends 704 of the coil springs 700, for use in a one-sided mattress, with the single support side underlying and proximate to the single support side of the one-sided mattress. The pockets or enclosures 750 of each coil spring 700 are formed, sewn or otherwise bonded together, typically in strands as known in the art, to maintain uniform orientation and alignment of the springs to form an innerspring. With each of the encapsulated coil springs being of asymmetric design, an asymmetric pocketed innerspring is provided wherein a configuration of the wire form part of the innerspring is different in an upper region proximate to the support side of the innerspring than in a lower region. The upper region of the asymmetric innerspring is installed under the support side of a one-sided mattress. In other words, the single sleep surface of a one-sided mattress is constructed over the support side 7001 of the innerspring 7000. In this embodiment, the relatively smaller diameter of the support ends 704 of the coil springs enables them to articulate or other deflect laterally as a group in response to off-axis loads and particularly to conform to body contours.

Figure 9A:
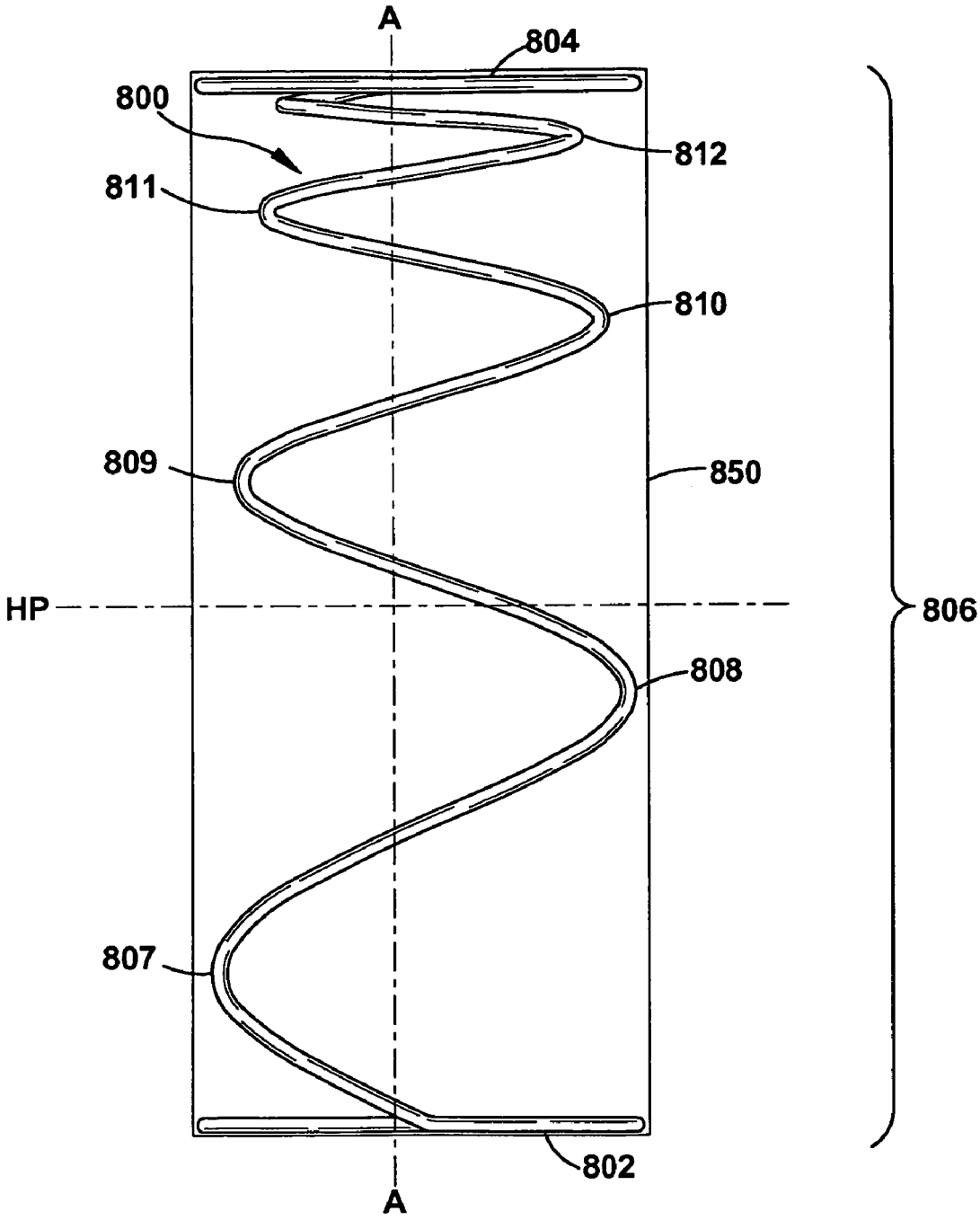
FIG. 9A is a profile view of an alternate embodiment of an asymmetric spring component of the present invention in the form of a coiled wire spring in combination with a cover or other encasement, also referred to as a pocketed asymmetric spring component.
Figure 9B:
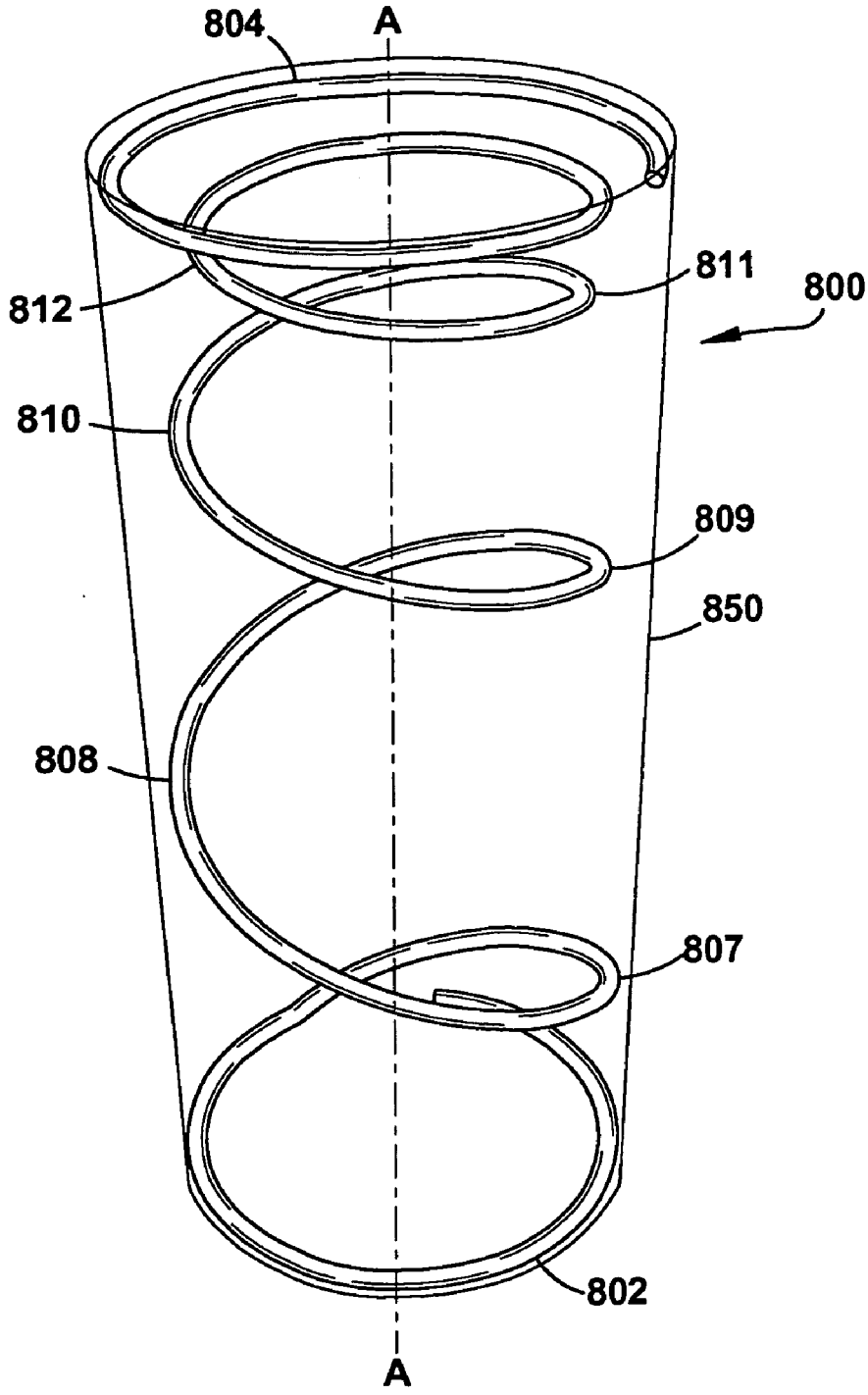
FIG. 9B is a perspective view of the pocketed asymmetric spring component of FIG. 9A.
Figure 9C:
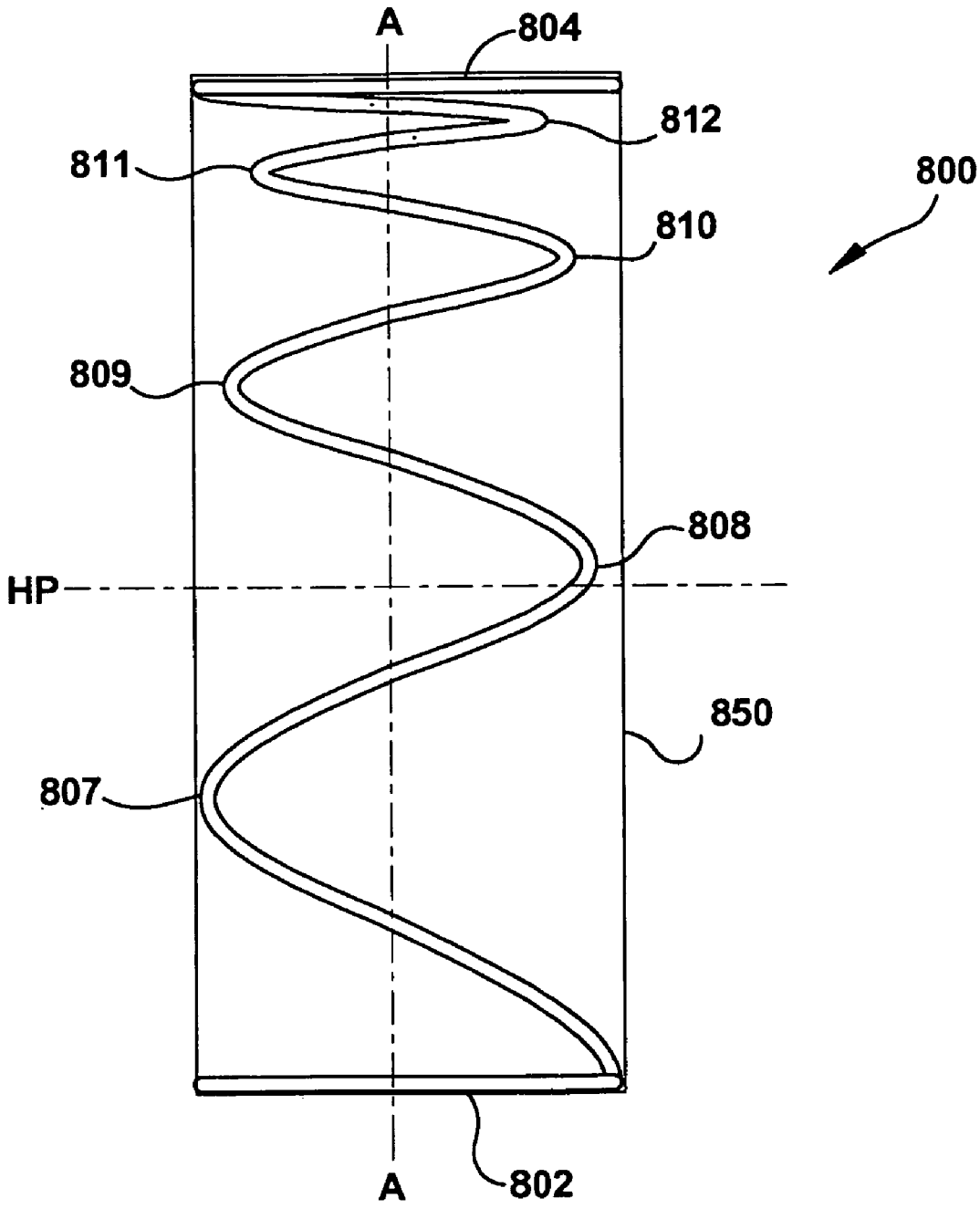
FIG. 9C is an alternate profile view of the pocketed asymmetric spring component of FIG. 9A.
Figure 9D:
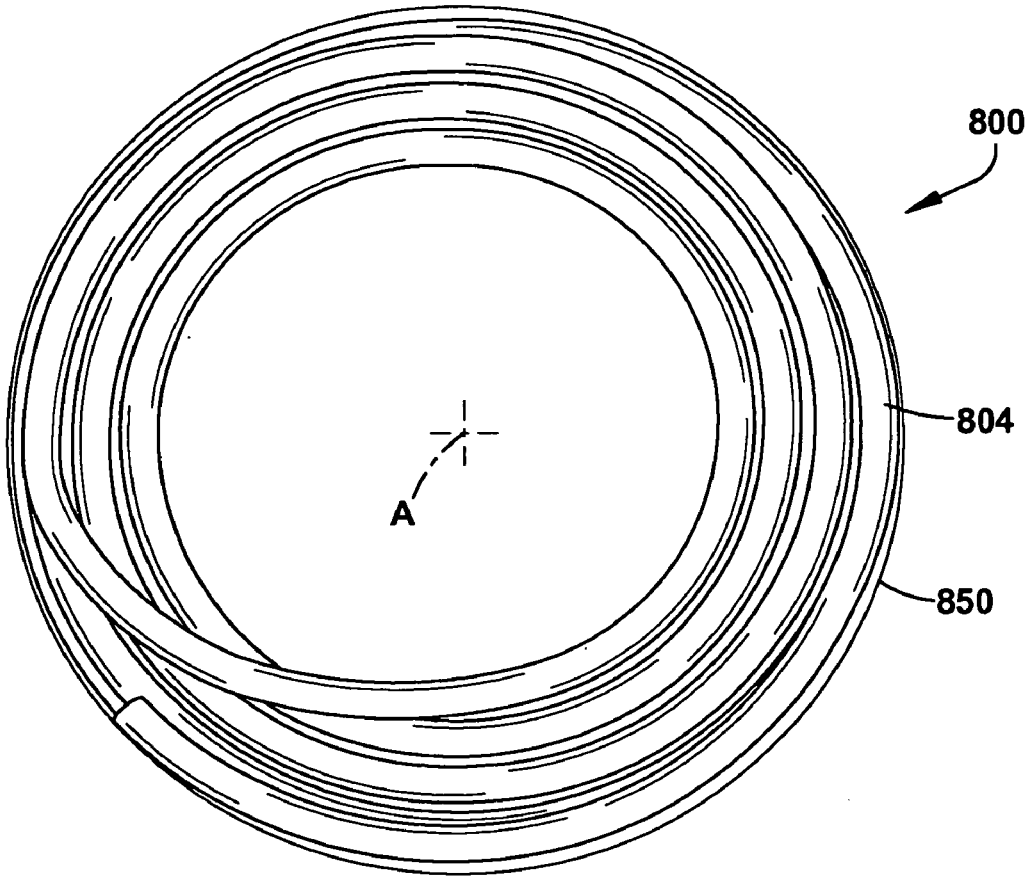
FIG. 9D is an end view of the pocketed asymmetric spring component of FIG. 9A.
Figure 9E:
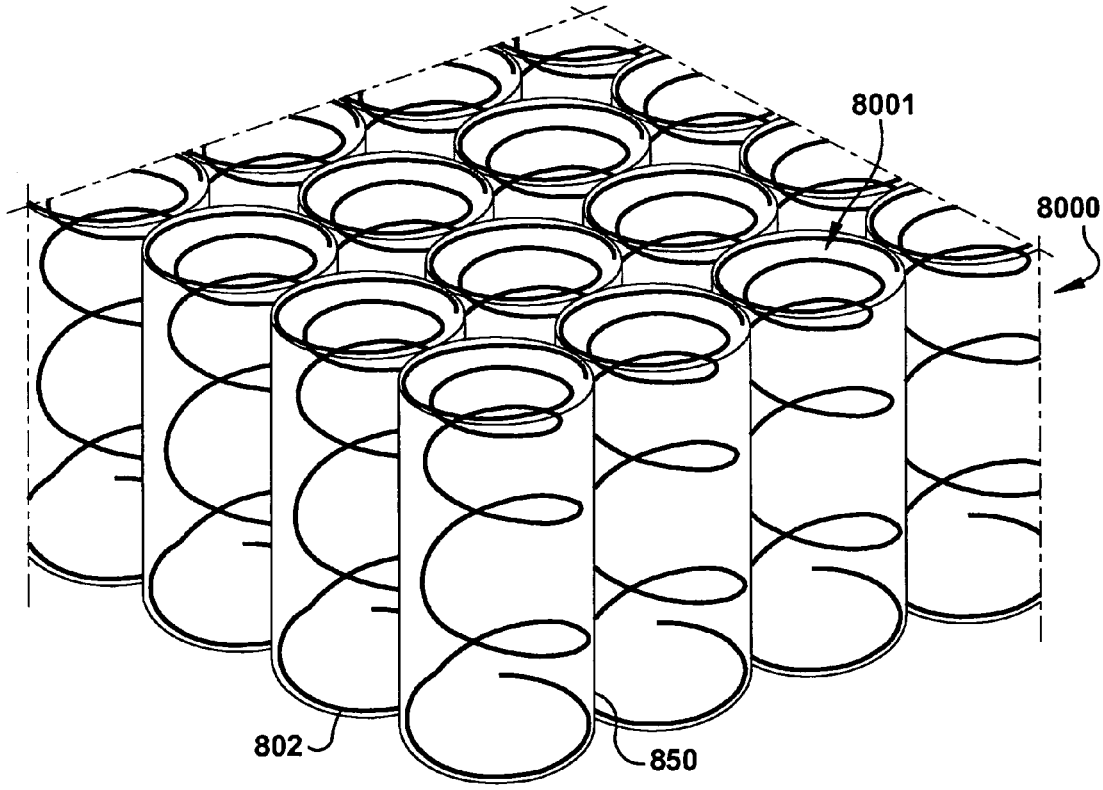
FIG. 9E is a perspective view of an asymmetric innerspring constructed with a plurality of pocketed asymmetric spring components of FIG. 9A, also referred to as a pocketed asymmetric innerspring or pocketed innerspring assembly.

FIGS. 9A–9E illustrate an alternate embodiment of an asymmetric spring coil 800 of the invention which is also suitable for use as a pocketed coil, as shown in enclosure 850. The pitch angles of the turns 807–812 are similar to those of spring coil 600 of FIGS. 7A–7E, but with the top 804 of the coil being of substantially larger diameter and radius, and can be as large as the diameter and radius of the bottom end 802. This provides the coil 800 with increased lateral stability and a larger structural support surface 8001 to the innerspring 8000 shown in FIG. 9E. As noted, coil springs with turns and ends of larger and equal radii can be used in a pocketed asymmetric innerspring without concern over interference between the turns of the springs, and still have the advantages of variable pitch and radius. FIG. 9E illustrates an asymmetric innerspring 8000 with a single support side 8001, formed by the co-planar arrangement of the larger diameter support ends 804 of the coil springs 800, for use in a one-sided mattress, with the single support side underlying and proximate to the single support side of the one-sided mattress. The pockets or enclosures 850 about each coil spring 800 are formed, sewn or otherwise bonded together, typically in strands as known in the art, to maintain uniform orientation and alignment of the springs to form an innerspring. With each of the encapsulated coil springs being of asymmetric design, an asymmetric pocketed innerspring is provided wherein a configuration of the wire form part of the innerspring is different in an upper region proximate to the support side of the innerspring than in a lower region. The upper region of the asymmetric innerspring is installed under the support side of a one-sided mattress. In other words, the single sleep surface of a one-sided mattress is constructed over the support side 8001 of the asymmetric pocketed innerspring 8000. In this embodiment, the large diameter of the support ends 804 creates a support side 8001 which has greater lateral stability, while still allowing some articulation of the coils in response to off-axis loads to conform to body contours. The one-sided asymmetric pocketed coil innerspring 8000 can be formed by arrangement of rows of pocketed coils 800 in a form or within surrounding walls of a mattress and then covered with padding and upholstery.

Figure 10:
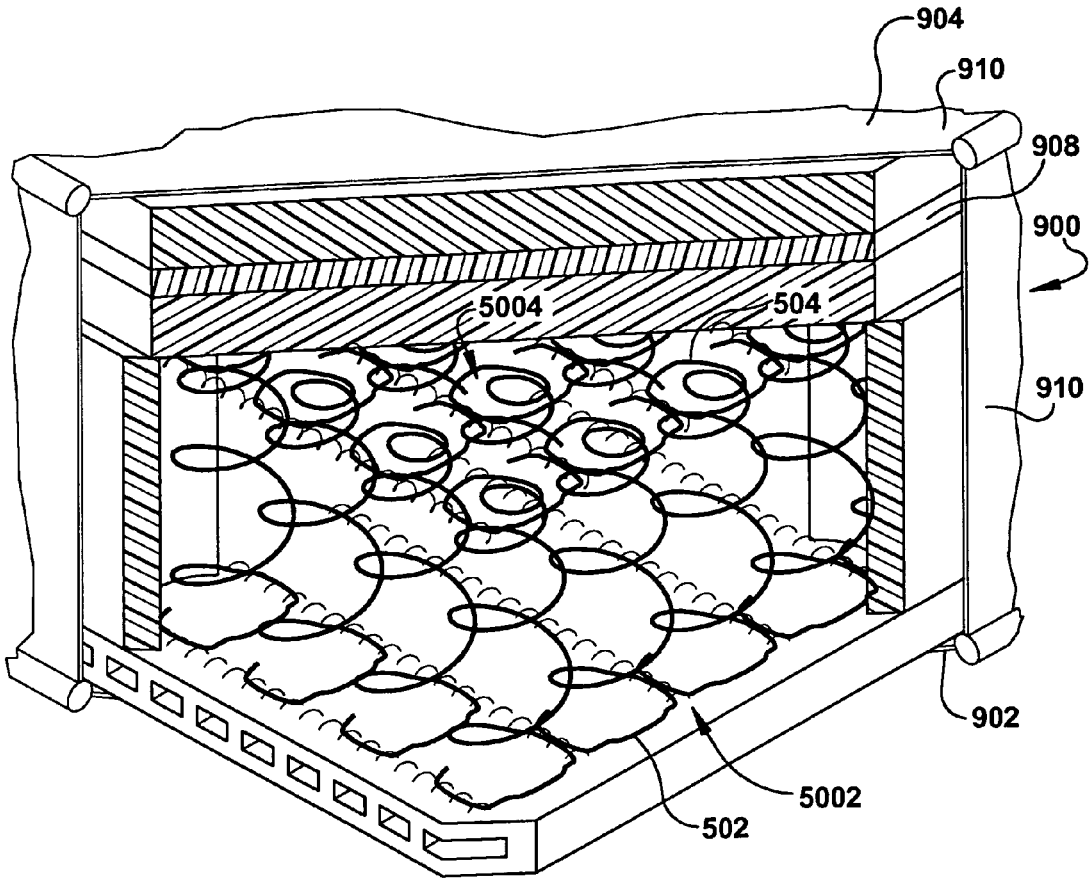
FIG. 10 is a perspective partial cutaway view of a one-sided mattress constructed with an asymmetric innerspring with asymmetric spring coils of the invention.

FIG. 10 illustrates a one-sided mattress of the invention, indicated generally at 900, which includes an asymmetric innerspring, indicated generally at 5000 as shown in FIG. 6, made of a plurality of asymmetric spring coils 500 forming a single support surface 5004 which is oriented toward and proximate to the single sleep surface 904 of the mattress 900. The lower ends 502 of the spring coils 500 form a bottom or base 5002 to the asymmetric innerspring 5000 which is oriented toward and proximate to the bottom or base 902 of the asymmetric one-sided mattress 900. As known in the industry, multiple internal padding layers 908 are provided in the upper region of the mattress, on top of the innerspring support surface 5004 and under the sleep surface 904 and covered by an upholstery or tick 910.

Figure 11:
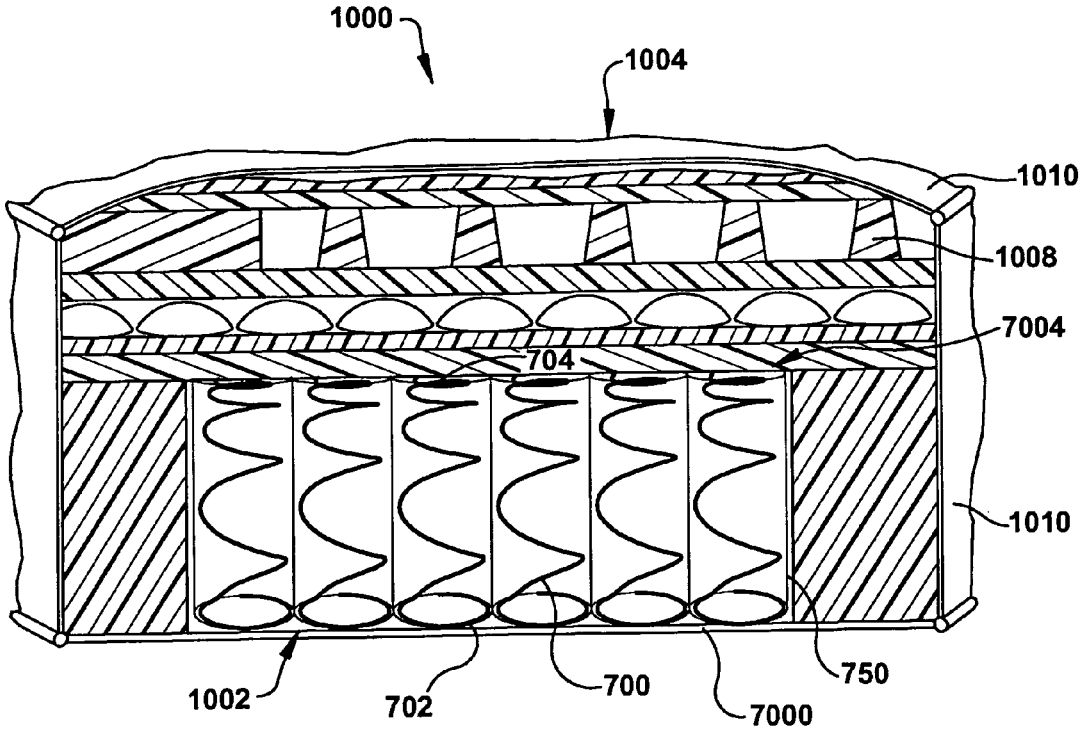
FIG. 11 is a perspective partial cutaway view of a one-sided mattress constructed with a pocketed asymmetric innerspring with pocketed asymmetric spring coils of the invention.

FIG. 11 illustrates a one-sided mattress of the invention, indicated generally at 1000, which includes an asymmetric pocketed coil innerspring, indicated generally at 7000, similar to that shown in FIG. 8E, made of a plurality of asymmetric spring coils 700 each encapsulated in a pocket or encasement 750, such as fabric or other flexible material and connected or otherwise arranged together in an array so that the upper ends 704 form a single support surface 7004 which is oriented toward and proximate to the single sleep surface 1004 of the mattress 1000. The lower ends 702 of the spring coils 700 form a bottom or base 7002 to the asymmetric pocketed innerspring 7000 which is oriented toward and proximate to the bottom or base 1002 of the asymmetric pocketed coil one-sided mattress 1000. As described with reference to FIGS. 8A–8E, the configuration of the spring coils 700 in an upper region proximate to the upper ends 704 is different than the configuration in a lower region proximate to the lower ends 702 so that the spring coils 704 and the innerspring 7000 are asymmetric in this respect. As known in the industry, multiple internal padding layers 1008 are provided in the upper region of the mattress, on top of the innerspring support surface 7004 and under the sleep surface 1004 and covered by an upholstery or tick 1010.

The invention thus provides new types of helical coil springs which are specifically designed to provide reflexive support at one axial end of the coil, and for inclusion in an innerspring assembly which also is designed to have a single support surface, for use in a one-sided mattress, or any other flexible support surface designed to have a single orientation. The asymmetry of the coil springs, whether with respect to a horizontal reference plane perpendicular to an axis of the coil, i.e. varying pitch to the turns of the coil, or a vertical reference plane, i.e., varying radii to the turns of the coil, allows coils to be specifically designed for one-sided applications such as one-sided mattress, to be tuned for optimum degrees of stiffness, response and articulation, and to take advantage of materials savings, particularly in the lower regions of the coils.

What is claimed as the invention is:

1. An asymmetric innerspring having a plurality of interconnected asymmetric wire form coil springs, each of the coil springs having a generally helical coil body with a plurality of turns with at least two of the turns having a unique pitch or radius, a support end contiguous with one end of the coil body, and a base end contiguous with an opposite end of the coil body, the support ends of the coil springs being arranged in a plane to define a single support side to the asymmetric innerspring, wherein there is a greater density of wire in an upper half of the innerspring than in a lower half of the innerspring, wherein the largest pitch angles of the coil springs are proximate to the base ends of the coil springs, and wherein the smallest pitch angles of the coil springs are proximate to the support ends of the coil springs, and wherein the coil springs are interconnected at the support ends.

2. The asymmetric innerspring of claim 1 wherein the coil springs are contained in flexible enclosures.

3. The asymmetric innerspring of claim 1 wherein the support end and the base end of the coil springs are formed with offsets.

4. The asymmetric innerspring of claim 1 wherein the support end and the base end of the coil springs are generally circular.

5. A one-sided mattress with a single sleep surface, the one-sided mattress comprising an asymmetric innerspring with a plurality of asymmetric coil springs, each asymmetric coil spring having a support end and a base end, and an asymmetric coil spring body between the support end and the base end wherein a configuration of the coil spring proximate to the support end is different than a configuration of the coil spring proximate to the base end, the support ends of the asymmetric coil springs arranged in a plane to define a single support side to the asymmetric innerspring, the single support side of the asymmetric innerspring underlying and proximate to the single sleep surface of the one-sided mattress, wherein the asymmetric innerspring has an upper region formed by an upper half of the asymmetric coil springs, and a lower region formed by a lower half of the asymmetric coil springs, and wherein a lower half of each of the asymmetric coil springs has fewer turns in the coil body than the upper half, whereby the asymmetric innerspring has a lesser amount of coil spring material in the lower region than in the upper region, and the coil springs are connected together at the support ends.

6. The one-sided mattress of claim 5 wherein the asymmetric innerspring is comprised of a plurality of asymmetric coil springs which are connected together by one or more lacing wires.

7. The one-sided mattress of claim 5 wherein the asymmetric coil springs of the asymmetric innerspring have a support end which is configured differently than a base end.

8. The one-sided mattress of claim 5 wherein the bodies of the asymmetric spring coils of the asymmetric innerspring are comprised of helical turns, each helical turn having a pitch angle, and at least two different pitch angles to the helical turns of the bodies of the spring coils.

9. The one-sided mattress of claim 5 wherein the bodies of the asymmetric coil springs of the asymmetric innerspring are comprised of helical turns, each helical turn having a radius, and at least two different radii to the helical turns of the bodies of the coil springs.

10. The one-sided mattress of claim 5 wherein the coil springs of the asymmetric innerspring have offsets on at least one of the support end or base end.

11. The one-sided mattress of claim 5 wherein the coil springs of the asymmetric innerspring are encapsulated in a flexible enclosure or pocket.

12. The one-sided mattress of claim 5 wherein the asymmetric coil springs of the asymmetric innerspring have a support end which is smaller than a base end.

13. The one-sided mattress of claim 5 wherein the asymmetric coil springs of the asymmetric innerspring have a support end which configured substantially the same as a base end.

14. The one-sided mattress of claim 5 wherein the asymmetric coil springs of the asymmetric innerspring are made of steel wire, and wherein the asymmetric innerspring has a lesser amount of steel wire in the lower region than in the upper region.

* * * * *